US008264132B2

(12) United States Patent
Kameda et al.

(10) Patent No.: US 8,264,132 B2
(45) Date of Patent: Sep. 11, 2012

(54) PLASMA JET IGNITION PLUG

(75) Inventors: Hiroyuki Kameda, Aichi-ken (JP); Naofumi Yamamura, Nagoya (JP); Daisuke Kasahara, Toyoake (JP)

(73) Assignee: NGK Spark Plug Co., Ltd., Aichi (JP)

( * ) Notice: Subject to any disclaimer, the term of this patent is extended or adjusted under 35 U.S.C. 154(b) by 0 days.

(21) Appl. No.: 13/176,247

(22) Filed: Jul. 5, 2011

(65) Prior Publication Data

US 2012/0007488 A1 Jan. 12, 2012

(30) Foreign Application Priority Data

Jul. 8, 2010 (JP) ..... 2010-155434
Mar. 4, 2011 (JP) ..... 2011-47115

(51) Int. Cl.
*H01T 13/20* (2006.01)

(52) U.S. Cl. ..... 313/141; 313/118; 313/142; 313/140

(58) Field of Classification Search ..... None
See application file for complete search history.

(56) References Cited

U.S. PATENT DOCUMENTS 7,305,954 B2 12/2007 Hagiwara et al. ..... 123/143
7,328,677 B2 2/2008 Hagiwara et al. ..... 123/143

FOREIGN PATENT DOCUMENTS

JP 2007-287666 11/2007
JP 4674219 1/2011

*Primary Examiner* — Natalie Walford
(74) *Attorney, Agent, or Firm* — Kusner & Jaffe

(57) ABSTRACT

An ignition plug that maintains excellent ignition performance over a long period of time through effective prevention of channeling. The ignition plug includes an insulator having an axial bore, a center electrode inserted into the axial bore, a metallic shell disposed externally of the outer circumference of the insulator, and a ground electrode fixed to a front end portion of the metallic shell. A cavity is defined by the wall surface of the axial bore and the front end surface of the center electrode. The ground electrode includes a body whose distal end portion is disposed away from the front end of the insulator, and a protrusion protruding from the body.

14 Claims, 9 Drawing Sheets

PLASMA JET IGNITION PLUG

FIELD OF THE INVENTION

The present invention relates to a plasma jet ignition plug for igniting an air-fuel mixture through formation of plasma.

BACKGROUND OF THE INVENTION

Conventionally, a combustion apparatus, such as an internal combustion engine, uses a spark plug for igniting an air-fuel mixture through spark discharge. In recent years, in order to meet demand for high output and low fuel consumption, a plasma jet ignition plug has been proposed, since the plasma jet ignition plug provides quick propagation of combustion and can more reliably ignite even a lean air-fuel mixture having a higher ignition-limit air-fuel ratio.

Generally, the plasma jet ignition plug includes a tubular insulator having an axial bore, a center electrode inserted into the axial bore in such a manner that a front end surface thereof is retracted from a front end surface of the insulator, a metallic shell disposed externally of the outer circumference of the insulator, and an annular ground electrode joined to a front end portion of the metallic shell. Also, the plasma jet ignition plug has a space (cavity) defined by the front end surface of the center electrode and a wall surface of the axial bore. The cavity communicates with an ambient atmosphere via a through hole formed in the ground electrode.

Additionally, such plasma jet ignition plug ignites an air-fuel mixture as follows. First, voltage is applied between the center electrode and the ground electrode, thereby generating spark discharge therebetween and thus causing dielectric breakdown therebetween. In this condition, high-energy current is applied between the center electrode and the ground electrode for effecting transition of a discharge state, thereby generating plasma within the cavity. The generated plasma is discharged through an opening of the cavity, thereby igniting the air-fuel mixture. For example, see Japanese Patent Application Laid-Open (kokai) No. 2007-287666 ("Patent Document 1").

SUMMARY OF THE INVENTION

Problems to be Solved by the Invention

Spark discharge is generated between the center electrode and the ground electrode while creeping on the inner circumferential surface of the insulator. Accordingly, there arises the phenomenon (so-called channeling) that spark discharge erodes a portion of the insulator located on a spark discharge path. Furthermore, since a spark discharge path which passes through an eroded portion of the insulator becomes shorter than other spark discharge paths, spark discharge is generated in a concentrated manner along the spark discharge path, causing local concentration of channeling. As a result, the insulator is eroded in a deep streaky manner. Thus, a groove lying on a line which connects the center electrode and a portion of the ground electrode located toward the outer circumference of the ground electrode may be formed on the wall of the cavity. Even though spark discharge is generated along this groove to thereby generate plasma, the plasma is less likely to be discharged outward due to the existence of the ground electrode. That is, the plasma jet ignition plug exhibits excellent ignition performance only at an early stage of use, and ignition performance may drastically deteriorate in the course of use.

Particularly, in the case where the ground electrode is disposed radially outward of the opening of the cavity as in the case of the above Patent Document 1, since spark discharge is urged toward the ground electrode; i.e., urged against the inner circumferential surface of the insulator, channeling may be more likely to arise.

The present invention has been conceived in view of the above circumstances, and an object of the invention is to provide a plasma jet ignition plug which can maintain excellent ignition performance over a long period of time through effective prevention of channeling.

Means for Solving the Problems

Configurations suitable for achieving the above object will next be described in itemized form. If needed, working effects peculiar to the configurations will be described additionally.

Configuration 1: A plasma jet ignition plug of the present configuration comprises an insulator having an axial bore extending therethrough in an axial direction; a center electrode inserted into the axial bore in such a manner that a front end thereof is located rearward of the front end of the insulator with respect to the axial direction; a metallic shell disposed externally of the outer circumference of the insulator; and a ground electrode fixed to a front end portion of the metallic shell. A cavity is defined by a wall surface of the axial bore and the front end surface of the center electrode. The plasma jet ignition plug is characterized in that the ground electrode comprises a rodlike body configured such that a proximal end portion thereof is fixed to the front end portion of the metallic shell, an intermediate portion thereof is bent, and a distal end portion thereof is disposed away from and frontward of the front end of the insulator with respect to the axial direction, and a protrusion protruding from a surface of the body, and that, as viewed on an imaginary plane which is orthogonal to the axial direction and onto which an opening of the cavity and the protrusion are projected, a projected image of the opening of the cavity and a projected image of the protrusion overlap at least partially.

According to the above configuration 1, the distal end portion of the rodlike ground electrode (the body) is disposed away from and frontward of the front end of the insulator. Accordingly, spark discharge is generated along a path in a gas from the opening of the cavity to the ground electrode (a gaseous discharge path). When discharge is generated in the gas, spark discharge is generated actively between the opening of the cavity and the protrusion of the ground electrode. In this connection, the configuration 1 is such that, when the protrusion and the cavity are projected onto an imaginary plane orthogonal to the axial direction, a projected image of the protrusion overlaps at least partially a projected image of the opening of the cavity (i.e., the protrusion overlies the opening of the cavity). Thus, a state in which a gaseous discharge path is excessively inclined radially outward can be restrained, thereby reliably preventing spark discharge from being generated in such a manner as to be excessively urged radially outward. As a result, channeling can be effectively prevented, whereby the plasma jet ignition plug can maintain excellent ignition performance over a long period of time.

Configuration 2: A plasma jet ignition plug of the present configuration is characterized in that, in the above configuration 1, the protrusion protrudes such that the distal end surface thereof protrudes from a side surface of the body located on a side toward the cavity.

According to the above configuration 2, the protrusion protrudes from a side surface of the body located on a side toward the cavity. Thus, gaseous discharge can be generated more reliably between the opening of the cavity and the protrusion of the ground electrode. As a result, the effect of preventing channeling can be further improved.

In view of further improvement of resistance to channeling, preferably, the cavity and relevant members are configured such that, as viewed on the above-mentioned imaginary plane, the projected image of the opening of the cavity and the projected image of the distal end surface of the protrusion overlap wholly. More preferably, the cavity and relevant members are configured such that the projected image of the distal end surface of the protrusion is located within the projected image of the opening of the cavity.

Configuration 3: A plasma jet ignition plug of the present configuration is characterized in that, in the above configuration 2, the protrusion exists between a first imaginary line and a second imaginary line drawn, on a section which contains the axis, in such a manner that the first imaginary line and the second imaginary line are in contact with an opening edge of the cavity, the intersection of the first and second imaginary lines is located on the axis, and the angle between the first and second imaginary lines on a side toward the protrusion is 90 degrees.

The above configuration 3 is such that an outer circumferential portion of the protrusion rather approaches the axis. Thus, a gaseous discharge path can be inclined radially inward. As a result, a radially outward urge of spark discharge can be further restrained, whereby channeling can be further reliably prevented.

Configuration 4: A plasma jet ignition plug of the present configuration is characterized in that, in the above configuration 3, the protrusion exists between the first imaginary line and the second imaginary line drawn in such a manner that the angle between the first and second imaginary lines on the side toward the protrusion is 60 degrees.

According to the above configuration 4, a gaseous discharge path can be inclined further radially inward. Thus, channeling can be further effectively prevented.

Configuration 5: A plasma jet ignition plug of the present configuration is characterized in that, in any one of the above configurations 1 to 4, a straight line extending from the center axis of the protrusion passes through the opening of the cavity.

According to the above configuration 5, a gaseous discharge path can be inclined further radially inward. Thus, the effect of restraining channeling can be further improved.

In the case where the center axis of the protrusion does not pass through the opening of the cavity (the protrusion is shifted radially outward relative to the opening of the cavity), the route of a discharge path may concentrate at a certain circumferential portion of the inner circumferential surface of the insulator, potentially resulting in concentrated generation of channeling at a certain portion of the insulator. However, according to the above configuration 5, the route of a discharge path can be dispersed on the inner circumferential surface of the insulator. As a result, the local concentration of channeling can be effectively prevented, whereby the plasma jet ignition plug can maintain excellent ignition performance over a longer period of time.

In view of further improvement of resistance to channeling, more preferably, in addition to satisfaction of the above configuration 5, the center axis of the protrusion is brought closer to the axis of the plasma jet ignition plug. Most preferably, the center axis of the protrusion coincides with the axis of the plasma jet ignition plug.

Configuration 6: A plasma jet ignition plug of the present configuration is characterized in that, in any one of the above configurations 1 to 5, when a value of $S0+S1\times0.5+S2$ is minimized, expressions $S0\times2+S1\geqq0.5$, $S1\geqq0.3$, and $S2\geqq0.3$ are satisfied, where S0 (mm) is a distance from the front end surface of the center electrode to a point on the wall surface of the axial bore; S1 (mm) is a distance from the point on the wall surface of the axial bore to the opening edge of the cavity as measured along the inner circumferential surface of the insulator; and S2 (mm) is a distance from the opening edge of the cavity to the protrusion as measured along the axial direction.

The expression "when a value of $S0+S1\times0.5+S2$ is minimized" is derived from a fact that spark discharge between the center electrode and the ground electrode is generated substantially along a path associated with a lowest discharge voltage and a fact that, when the length of a discharge path is fixed, a voltage required for creeping discharge is about half of a voltage required for gaseous discharge. Therefore, when a value of $S0+S1\times0.5+S2$ is minimized (i.e., when discharge voltage is conceived to assume a lowest value), spark discharge is generated substantially along a path composed of the distances S0, S1, and S2.

According to the above configuration 6, when a value of $S0+S1\times0.5+S2$ is minimized, the distances S0 and S1 satisfy the expression $S0\times2+S1\geqq0.5$, where the distance S0 corresponds to the length of a gaseous discharge path from the front end surface to a point on the wall surface of the axial bore, the distance S1 corresponds to the length of a path (a creeping discharge path) extending on the surface of the insulator from the point on the wall surface of the axial bore (an end point of the distance S0 on a side toward the axial bore) to the opening edge of the cavity, and the distance S2 corresponds to the length of a gaseous discharge path from the opening edge to the protrusion. That is, the length of a discharge path within the cavity is 0.5 mm or longer. Therefore, sufficient plasma can be generated within the cavity.

Additionally, according to the above configuration 6, the distance S1 is 0.3 mm or longer; i.e., the axial length of the cavity is 0.3 mm or longer. Therefore, a situation in which pressure associated with generation of plasma causes dispersion of an ambient gas which contributes to the growth of plasma is unlikely to arise. Thus, plasma can be more reliably grown.

Also, according to the above configuration 6, the distance S2 is 0.3 mm or longer. Thus, the protrusion is not excessively close to the opening of the cavity. Therefore, the obstruction of discharge of plasma by the protrusion, and heat transfer from plasma to the protrusion (ground electrode) can be more reliably prevented.

As mentioned above, according to the above configuration 6, through synergy of the above-mentioned working effects, ignition performance can be greatly improved.

Configuration 7: A plasma jet ignition plug of the present configuration is characterized in that, in any one of the above configurations 1 to 6, the distance S0 (mm) from the front end surface of the center electrode to a point on the wall surface of the axial bore, the distance S1 (mm) from the point on the wall surface of the axial bore to the opening edge of the cavity as measured along the inner circumferential surface of the insulator, and the distance S2 (mm) from the opening edge of the cavity to the protrusion as measured along the axial direction satisfy an expression $S0+S1\times0.5+S2\leqq1.5$ (mm).

In view that discharge voltage increases gradually with erosion of the center electrode and that the higher the discharge voltage, the more channeling is likely to arise on the insulator, desirably, discharge voltage at an early stage of use (before the center electrode, etc. are eroded) is relatively low.

In this regard, according to the above configuration 7, the shapes of the cavity and the center electrode, the relative position between the protrusion and the cavity, etc., are determined such that the distances S0, S1, and S2 satisfy the expression $S0+S1\times0.5+S2\leqq1.5$ (mm). Thus, discharge voltage at an early stage of use can be restrained to a relatively low level, thereby effectively preventing misfire and progress of channeling associated with an increase in discharge voltage.

Configuration 8: A plasma jet ignition plug of the present configuration is characterized in that, in any one of the above configurations 1 to 7, the cavity has a diameter-reduced portion whose diameter reduces toward the opening of the cavity.

According to the above configuration 8, the cavity has a diameter-reduced portion. Thus, the discharge pressure of plasma from the cavity can be increased, so that plasma can be discharged vigorously. As a result, ignition performance can be improved very effectively.

Meanwhile, in association with the provision of the diameter-reduced portion, the inner circumferential surface of the insulator is curved (stepped). As a result, the insulator is likely to be eroded at the curved (stepped) portion. Accordingly, channeling may be likely to arise on the inner circumferential surface of the insulator. In this regard, through employment of the above configurations 1 to 7, resistance to channeling can be improved. Thus, the effect of improving ignition performance through provision of the diameter-reduced portion can be maintained over a long period of time. In other words, the above configurations 1 to 7 are particularly significant for a plasma jet ignition plug in which the cavity has a diameter-reduced portion.

Configuration 9: A plasma jet ignition plug of the present configuration is characterized in that, in any one of the above configurations 1 to 7, the cavity is a circular columnar space, and the cavity satisfies the following expressions (1) and (2)

$$L \geqq D \quad (1)$$

$$0.5 \leqq D \leqq 2.0 \quad (2)$$

where D (mm) is the inside diameter of the cavity, and L (mm) is the length of the cavity along the axis (CL1).

According to the above configuration 9, the cavity is a circular columnar space, and no curved (stepped) portion is formed on the inner circumferential surface of the insulator. Thus, as compared with the case where the diameter-reduced portion is formed as in the above configuration 8, the progress of channeling can be more reliably restrained.

Meanwhile, as compared with the case where the diameter-reduced portion is provided, employment of a circular columnar cavity may be inferior in terms of ignition performance. However, according to the above configuration 9, the cavity satisfies the expressions $L \geqq D$ and $D \leqq 2.0$, where D (mm) is the inside diameter of the cavity, and L (mm) is the axial length of the cavity. Thus, the radial expansion of plasma can be restrained, and the discharge velocity of plasma along the axial direction can be increased. As a result, the discharge length of plasma from the opening of the cavity can be further increased, so that ignition performance can be further improved.

When the inside diameter D of the cavity is reduced excessively, in a low-temperature environment immediately after startup, the cavity is apt to be clogged with liquefied fuel. Thus, startup performance may deteriorate. Also, since reducing the diameter of the cavity is accompanied by a reduction in the diameter of the center electrode, the heat resistance and erosion resistance of the center electrode may deteriorate. Therefore, in order to prevent a deterioration in startup performance, heat resistance, etc., preferably, the inside diameter D of the cavity is 0.5 mm or greater.

Configuration 10: A plasma jet spark plug of the present configuration is characterized in that, in any one of the above configurations 1 to 9, the protrusion is formed from a metal which contains at least one of tungsten (W), iridium (Ir), platinum (Pt), and nickel (Ni).

According to the above configuration 10, the protrusion is formed from a metal which contains at least one of W, Ir, etc. Thus, the protrusion can enjoy improvement in resistance to erosion caused by spark discharge and the like. Accordingly, the rate of increase of discharge voltage associated with erosion of the protrusion can be restrained. As a result, the period when spark discharge and, in turn, plasma, can be generated can be elongated, and channeling can be further restrained.

Configuration 11: A plasma ignition plug of the present configuration is characterized in that, in any one of the above configurations 1 to 10, a portion of the center electrode which extends rearward by 0.3 mm from the front end of the center electrode in the axial direction is formed from a metal which contains at least one of W, Ir, Pt, and Ni.

According to the above configuration 11, at least a front end portion of the center electrode is formed from a metal which contains at least one of W, Ir, etc. Thus, the center electrode can enjoy improvement in resistance to erosion caused by spark discharge and the like. Accordingly, the rate of increase of discharge voltage associated with erosion of the center electrode can be restrained. As a result, the period when spark discharge and the like can be generated can be elongated, and resistance to channeling can be further improved.

Configuration 12: A plasma jet ignition plug of the present configuration is characterized in that, in any one of the configurations 1 to 11, as viewed on a section of the axial bore which contains the front end surface of the center electrode, the outside diameter of the front end surface of the center electrode and the inside diameter of the axial bore are substantially equal to each other.

The expression "the outside diameter of the front end surface of the center electrode and the inside diameter of the axial bore are substantially equal to each other" means that, even when some difference exists between the outside diameter of the front end surface and the inside diameter of the axial bore because of manufacturing tolerances and the like, they are considered to be equal to each other.

According to the above configuration 12, as viewed on a section of the axial bore which contains the front end surface of the center electrode, the outside diameter of the front end surface of the center electrode and the inside diameter of the axial bore are substantially equal to each other. Thus, the generation of gaseous discharge between the front end surface of the center electrode and the wall surface of the axial bore can be restrained. As a result, discharge voltage at an early stage of use can be restrained to a relatively low level, thereby effectively preventing misfire and progress of channeling associated with an increase in discharge voltage.

Also, since the outside diameter of the front end surface of the center electrode is maximized within the axial bore, erosion resistance of the center electrode can be improved.

Configuration 13: A plasma jet ignition plug of the present configuration is characterized in that, in the above configuration 12, when a first distance represents the shortest distance from the front end surface of the center electrode to the opening edge of the cavity as measured along the inner circumferential surface of the insulator, and a second distance represents the shortest distance from the opening edge of the cavity to the protrusion as measured along the axial direction, the first distance is 0.5 mm or more, and the second distance is 0.3 mm or more.

According to the above configuration 13, the first distance, which is the shortest distance from the front end surface of the center electrode to the opening edge of the cavity as measured along the inner circumferential surface of the insulator (i.e., the length of the shortest creeping discharge path), is 0.5 mm or more, thereby ensuring that a discharge path within the cavity has a sufficient length, and the cavity has a sufficient axial length. Thus, a sufficient amount of plasma can be generated. Also, a situation in which pressure associated with generation of plasma causes dispersion of an ambient gas which contributes to the growth of plasma is unlikely to arise. Thus, plasma can be more reliably grown. As a result, ignition performance can be improved.

Also, according to the above configuration 6, the second distance, which is the shortest distance from the opening edge of the cavity to the distal end surface of the protrusion as measured along the axis (i.e., the length of the shortest gaseous discharge path), is 0.3 mm or more. Thus, the protrusion is not excessively close to the opening of the cavity. Therefore, the obstruction of discharge of plasma by the protrusion, and heat transfer from plasma to the protrusion (ground electrode) can be more reliably prevented. As a result, ignition performance can be further improved.

Configuration 14: A plasma jet ignition plug of the present configuration is characterized in that, in the above configuration 12 or 13, when a first distance S1 (mm) represents the shortest distance from the front end surface of the center electrode to the opening edge of the cavity as measured along the inner circumferential surface of the insulator, and a second distance S2 (mm) represents the shortest distance from the opening edge of the cavity to the protrusion as measured along the axis, the first distance S1 and the second distance S2 satisfy the expression $S1 \times 0.5 + S2 \leqq 1.5$ (mm).

According to the above configuration 14, the shape of the cavity, etc., are determined such that the first distance S1 and the second distance S2 satisfy the expression $S1 \times 0.5 + S2 \leqq 1.5$ (mm). Thus, discharge voltage at an early stage of use can be restrained to a relatively low level, thereby effectively preventing misfire and progress of channeling associated with an increase in discharge voltage.

DETAILED DESCRIPTION OF THE INVENTION

Figure 1:
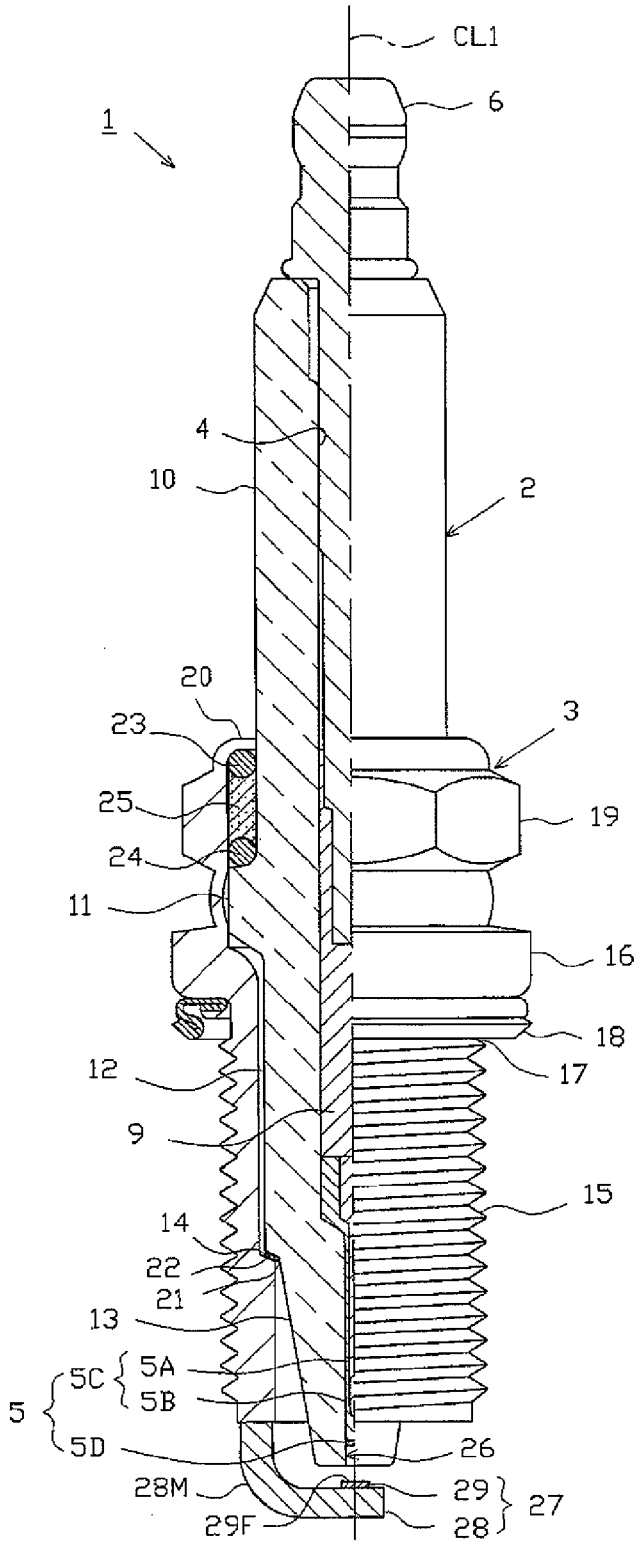
FIG. 1 is a partially cutaway front view showing the configuration of a plasma jet ignition plug.

An embodiment of the present invention will next be described with reference to the drawings. FIG. 1 is a partially cutaway front view showing a plasma jet ignition plug (hereinafter, referred to as the "ignition plug") 1. In the following description, the direction of an axis CL1 of the ignition plug 1 in FIG. 1 is referred to as the vertical direction, and the lower side of the ignition plug 1 in FIG. 1 is referred to as the front side of the ignition plug 1, and the upper side as the rear side of the ignition plug 1.

The ignition plug 1 includes a tubular insulator 2 and a tubular metallic shell 3, which holds the insulator 2 therein.

The insulator 2 is formed from alumina or the like by firing, as well known in the art. The insulator 2, as viewed externally, includes a rear trunk portion 10 formed on the rear side; a large-diameter portion 11, which is located frontward of the rear trunk portion 10 and projects radially outward; an intermediate trunk portion 12, which is located frontward of the large-diameter portion 11 and is smaller in diameter than the large-diameter portion 11; and a leg portion 13, which is located frontward of the intermediate trunk portion 12 and is smaller in diameter than the intermediate trunk portion 12. Additionally, the large-diameter portion 11, the intermediate trunk portion 12, and most of the leg portion 13 of the insulator 2 are accommodated within the metallic shell 3. A tapered, stepped portion 14 is formed at a connection portion between the intermediate trunk portion 12 and the leg portion 13. The insulator 2 is seated on the metallic shell 3 at the stepped portion 14.

Furthermore, the insulator 2 has an axial bore 4 extending therethrough along the axis CL1. A center electrode 5 is fixedly inserted into a front end portion of the axial bore 4. The center electrode 5 includes a base metal 5C composed of an inner layer 5A made of, for example, copper or a copper alloy, which has excellent thermal conductivity, and an outer layer 5B made of a nickel (Ni) alloy (e.g. INCONEL 600 or 610 (trade name)) which contains nickel as a main component; and an electrode tip 5D joined to the front end of the base metal 5C (the constitution of the electrode tip 5D will be described in detail later). Furthermore, the center electrode 5 assumes a rodlike (circular columnar) shape as a whole. The front end of the center electrode 5 is disposed rearward of the front end surface of the insulator 2.

Also, a terminal electrode 6 is fixedly inserted into a rear end portion of the axial bore 4 and projects from the rear end of the insulator 2.

A circular columnar glass seal layer 9 is disposed within the axial bore 4 between the center electrode 5 and the terminal electrode 6. By means of the glass seal layer 9, the center electrode 5 and the terminal electrode 6 are electrically connected together and fixed to the insulator 2.

Additionally, the metallic shell 3 is formed into a tubular shape from a low-carbon steel or a like metal. The metallic shell 3 has, on its outer circumferential surface, a threaded portion (externally threaded portion) 15 adapted to mount the ignition plug 1 into a mounting hole of a combustion apparatus (e.g., an internal combustion engine or a fuel cell reformer). Also, the metallic shell 3 has, on its outer circumferential surface, a seat portion 16 located rearward of the threaded portion 15. A ring-like gasket 18 is fitted to a screw neck 17 at the rear end of the threaded portion 15. Furthermore, the metallic shell 3 has, near the rear end thereof, a tool engagement portion 19 having a hexagonal cross section and allowing a tool, such as a wrench, to be engaged therewith when the ignition plug 1 is to be mounted to the combustion apparatus. Also, the metallic shell 3 has a crimp portion 20 provided at a rear end portion thereof for retaining the insulator 2.

Also, the metallic shell 3 has, on its inner circumferential surface, a tapered, stepped portion 21 adapted to allow the insulator 2 to be seated thereon. The insulator 2 is inserted frontward into the metallic shell 3 from the rear end of the metallic shell 3. In a state in which the stepped portion 14 of the insulator 2 butts against the stepped portion 21 of the metallic shell 3, a rear-end opening portion of the metallic shell 3 is crimped radially inward; i.e., the crimp portion 20 is formed, whereby the insulator 2 is fixed to the metallic shell 3. An annular sheet packing 22 intervenes between the stepped portions 14 and 21 of the insulator 2 and the metallic shell 3, respectively. This retains gastightness of a combustion chamber and prevents outward leakage of fuel gas through a clearance between the leg portion 13 of the insulator 2 and the inner circumferential surface of the metallic shell 3.

Furthermore, in order to ensure gastightness which is established by crimping, annular ring members 23 and 24 intervene between the metallic shell 3 and the insulator 2 in a region near the rear end of the metallic shell 3, and a space between the ring members 23 and 24 is filled with a powder of talc 25. That is, the metallic shell 3 holds the insulator 2 via the sheet packing 22, the ring members 23 and 24, and the talc 25.

Also, the insulator 2 has a cavity 26 provided in a front end portion thereof and defined by a wall surface of the axial bore 4 and the front end surface of the center electrode 5. The cavity 26 is a circular columnar space and opens frontward. The wall surface of the axial bore 4 used to define the cavity 26 may be inclined to some extent (within ±5°) with respect to the axis CL1. The cavity 26 does not necessarily have an exactly cylindrical shape (e.g., the cavity 26 may be shaped in such a manner as to be tapered frontward). In this case, an inside diameter D of the cavity 26, which will be described later, is the average of inside diameters measured at a plurality of positions located along the direction of the axis CL1 (for example, inside diameters measured at the front end and the rear end of the cavity 26).

Additionally, the electrode tip 5D constitutes a portion of the center electrode 5 which extends rearward by at least 0.3 mm from the front end of the center electrode 5 in the direction of the axis CL1. The electrode tip 5D is formed from a metal which contains at least one of tungsten (W), iridium (Ir), platinum (Pt), and nickel (Ni).

Additionally, in the present embodiment, a ground electrode 27 is joined to a front end portion of the metallic shell 3. The ground electrode 27 includes a rodlike body 28 and a circular columnar protrusion 29 joined to the body 28.

The body 28 is provided as follows: a proximal end portion thereof is joined to a front end portion of the metallic shell 3, and an intermediate portion 28M thereof is bent in such a manner that a distal end portion thereof approaches the center electrode 5. A distal end portion of the body 28 and the protrusion 29 are disposed away from and frontward of the front end of the insulator 2 with respect to the direction of the axis CL1. Thus, spark discharge is generated between the ground electrode 27 and the center electrode 5 along a path on the inner circumferential surface of the insulator 2 from the center electrode 5 to the opening of the cavity 26 (a creeping discharge path) and a path in a gas from the opening of the cavity 26 to the ground electrode 27 (protrusion 29) (a gaseous discharge path). The spark discharge causes the generation of plasma.

Figure 2:
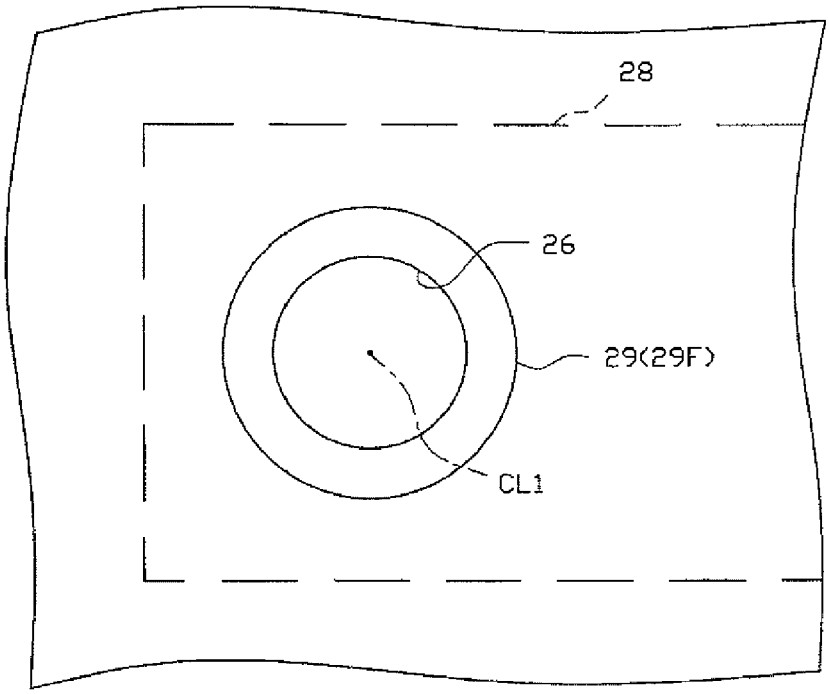
FIG. 2 is a view showing the distal end surface of a protrusion, the opening of a cavity, etc., as projected on an imaginary plane.

Additionally, the protrusion 29 is formed from a metal which contains at least one of W, Ir, Pt, and Ni and is provided such that a distal end surface 29F thereof protrudes from a side of the body 28 located toward the cavity 26. The distal end surface 29F of the protrusion 29 and the opening of the cavity 26 face each other. As a result, as shown in FIG. 2, when the opening of the cavity 26 and the protrusion 29 are projected onto an imaginary plane orthogonal to the axis CL1, a projected image of the opening of the cavity 26 and a projected image of the protrusion 29 overlap at least partially. In the present embodiment, the inside diameter of the opening of the cavity 26 is smaller than the outside diameter of the distal end surface 29F of the protrusion 29, and the axis CL1 and the center axis of the protrusion 29 coincide with each other. Thus, as viewed on the imaginary plane, the projected image of the opening of the cavity 26 falls within the projected image of the distal end surface 29F of the protrusion 29.

Figure 3:
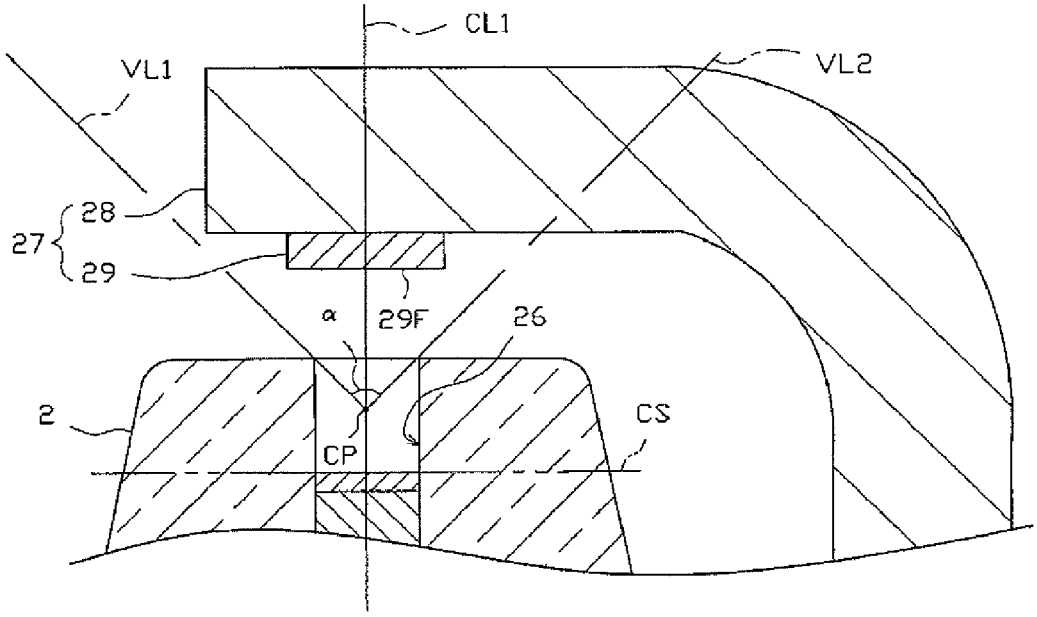
FIG. 3 is an enlarged, fragmentary, sectional view showing the configuration of the cavity, the protrusion, etc.

Furthermore, as shown in FIG. 3, as viewed on a section CS of the axial bore 4 which contains the front end surface of the center electrode 5, the outside diameter of the front end surface of the center electrode 5 and the inside diameter of the axial bore 4 are substantially equal to each other (e.g., the difference between the outside diameter of the center electrode 5 and the inside diameter of the axial bore 4 is 0.2 mm or less). Particularly, in the present embodiment, within a range from the front end surface of the center electrode 5 to an axial position located at least 0.5 mm rearward of the front end surface of the center electrode 5, the outside diameter of the front end surface of the center electrode 5 and the inside diameter of the axial bore 4 are substantially equal to each other.

Figure 4:
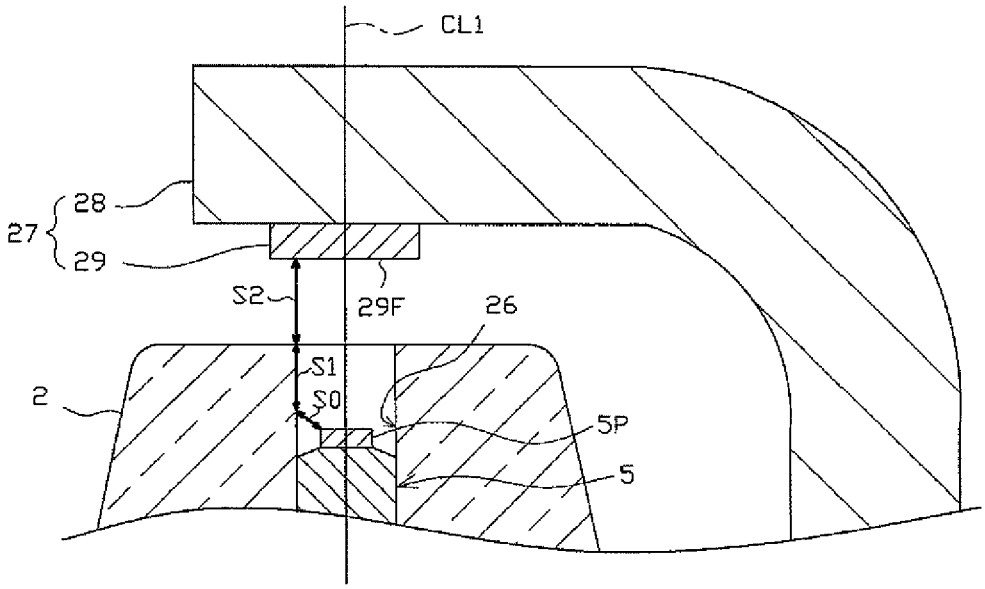
FIG. 4 is an enlarged, fragmentary, sectional view showing another example of a center electrode.

The plasma jet ignition plug 1 may be configured as shown in FIG. 4. Specifically, a front end portion of the center electrode 5 has a circular columnar protrusion 5P protruding frontward with respect to the direction of the axis CL1, and, as viewed on a section of the axial bore 4 which contains the front end surface of the center electrode 5, an annular clearance is formed between the front end surface of the center electrode 5 and the axial bore 4. That is, the plasma jet ignition plug 1 may be configured such that, when spark discharge is generated between the center electrode 5 and the ground electrode 27, gaseous discharge is generated between the front end surface of the center electrode 5 and the wall surface of the axial bore 4.

Referring back to FIG. 3, the protrusion 29 exists between a first imaginary line VL1 and a second imaginary line VL2 drawn, on a section which contains the axis CL1, in the following manner: the first imaginary line VL1 and the second imaginary line VL2 are in contact with the opening edge of the cavity 26; an intersection CP of the first and second imaginary lines VL1 and VL2 is located on the axis CL1; and the angle $\alpha$ between the first and second imaginary lines VL1 and VL2 on a side toward the protrusion 29 is 90 degrees.

Figure 5:
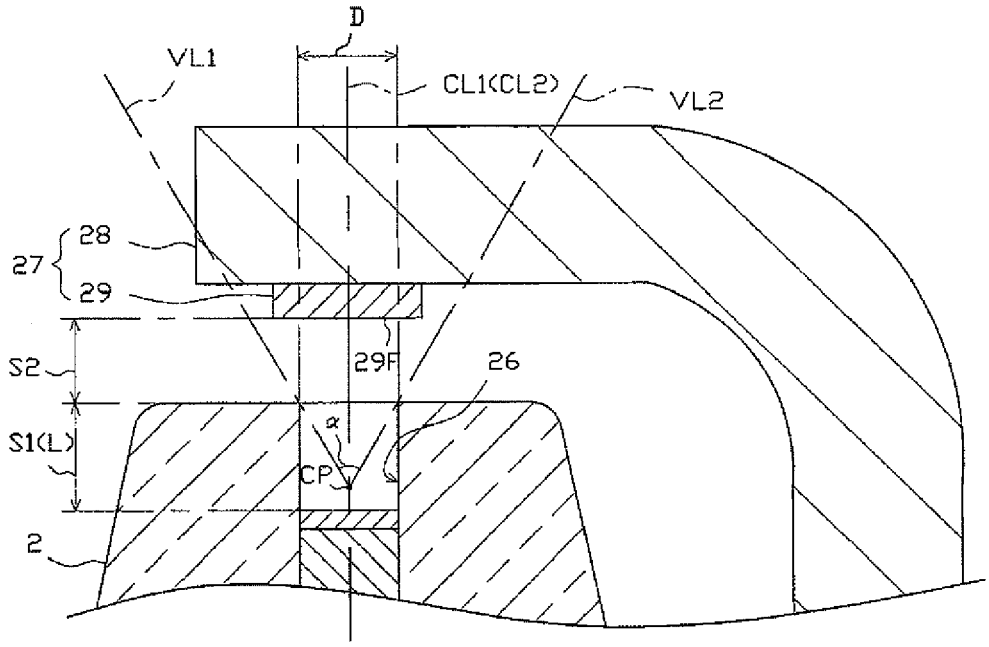
FIG. 5 is an enlarged, fragmentary, sectional view showing the configuration of the cavity, the protrusion, etc.

As shown in FIG. 5, in the present embodiment, the protrusion 29 also exists between the first and second imaginary lines VL1 and VL2 even when the first and second imaginary lines VL1 and VL2 are drawn in such a manner that an angle α between the first and second imaginary lines VL1 and VL2 on the side toward the protrusion 29 is 60 degrees.

Furthermore, the relative position between the protrusion 29 and the cavity 26 is determined in such a manner that a straight line CL2 extending from the center axis of the protrusion 29 passes through the opening of the cavity 26 (in the present embodiment, the straight line CL2 and the axis CL1 coincide with each other).

Also, as shown in FIGS. 4 and 5, when the value of S0+S1×0.5+S2 is minimized, S0, S1, and S2 satisfy the expressions S0×2+S1≧0.5, S1≧0.3, and S2≧0.3, where S0 (mm) is the distance from the front end surface of the center electrode 5 to a point on the wall surface of the axial bore 4, S1 (mm) is the distance from the point on the wall surface of the axial bore 4 to the opening edge of the cavity 26 as measured along the inner circumferential surface of the insulator 2, and S2 (mm) is the distance from the opening edge of the cavity 26 to the protrusion 29 as measured along the direction of the axis CL1. Also, the distances S0, S1, and S2 satisfy the expression S0+S1×0.5+S2≦1.5 (mm).

In the present embodiment, as mentioned above, the outside diameter of the front end surface of the center electrode 5 and the inside diameter of the axial bore 4 are substantially equal to each other. Thus, the distance S0 is substantially zero. Therefore, the shortest distance from the front end surface of the center electrode 5 to the opening edge of the cavity 26 as measured along the inner circumferential surface of the insulator 2 (i.e., the length of the shortest creeping discharge path) is a first distance S1 (mm), and the shortest distance from the opening edge of the cavity 26 to the distal end surface 29F of the protrusion 29 as measured along the direction of the axis CL1 (i.e., the length of the shortest gaseous discharge path) is a second distance S2 (mm). As a result, the first distance S1 (mm) and the second distance S2 (mm) satisfy the expressions S1≧0.5, S2≧0.3, and S1×0.5+S2≦1.5.

Additionally, as mentioned above, the cavity 26 is a circular columnar space and satisfies the following expressions (1) and (2):

$$L \geqq D \quad (1)$$

$$0.5 \leqq D \leqq 2.0 \quad (2)$$

where D (mm) is the inside diameter of the cavity 26, and L (mm) is the length of the cavity 26 along the axis CL1.

As described in detail above, according to the present embodiment, spark discharge is generated along a path on the inner circumferential surface of the insulator 2 from the front end surface of the center electrode 5 to the opening of the cavity 26 (a creeping discharge path) and along a path in a gas from the opening of the cavity 26 to the ground electrode 27 (protrusion 29) (a gaseous discharge path). When discharge is generated in the gas, spark discharge is generated actively between the opening of the cavity 26 and the protrusion 29. In this connection, according to the present embodiment, when the protrusion 29 and the cavity 26 are projected onto an imaginary plane, a projected image of the distal end surface of the protrusion 29 overlaps at least partially a projected image of the opening of the cavity 26 (i.e., the protrusion 29 overlies the opening of the cavity 26). Thus, a state in which a gaseous discharge path is excessively inclined radially outward can be restrained, thereby reliably preventing spark discharge from being generated in such a manner as to be excessively urged radially outward. As a result, channeling can be effectively prevented, whereby excellent ignition performance can be maintained over a long period of time.

Furthermore, according to the present embodiment, as viewed on a section which contains the axis CL1, the protrusion 29 exists between the first imaginary line VL1 and the second imaginary line VL2 which form an angle α of 60°, and an outer circumferential portion of the protrusion 29 approaches the axis CL1. Thus, a gaseous discharge path can be inclined radially inward. As a result, a radially outward urge of spark discharge can be further restrained, whereby channeling can be further reliably prevented.

Additionally, according to the present embodiment, since the straight line CL2 extending from the center axis of the protrusion 29 passes through the opening of the cavity 26, the route of a discharge path can be dispersed on the inner circumferential surface of the insulator 2. As a result, the local concentration of channeling can be effectively prevented, whereby excellent ignition performance can be maintained over a longer period of time.

Furthermore, when the value of S0+S1×0.5+S2 is minimized, the distances S0 and S1 satisfy the expressions S0×2+S1≧0.5 and S1≧0.3 (in the present embodiment, since the distance S0 is approximately zero, the first distance S1 is 0.5 mm or more). Thus, a sufficient amount of plasma can be generated. Also, a situation in which pressure associated with generation of plasma causes dispersion of an ambient gas which contributes to the growth of plasma is unlikely to arise. As a result, plasma can be more reliably grown, and ignition performance can be improved.

According to the present embodiment, the second distance S2 is 0.3 mm or more; thus, the protrusion 29 is not excessively close to the opening of the cavity 26. Therefore, the obstruction of discharge of plasma by the protrusion 29, and heat transfer from plasma to the protrusion 29 (the ground electrode 27) can be more reliably prevented. Thus, ignition performance can be further improved.

Furthermore, the distances S0, S1, and S2 satisfy the expression S0+S1×0.5+S2≦1.5 (mm) (in the present embodiment, since the distance S0 is substantially zero, the first distance S1 and the second distance S2 satisfy the expression S1×0.5+S2≦1.5 (mm)). Therefore, discharge voltage at an early stage of use can be restrained to a low level, thereby effectively preventing misfire and progress of channeling associated with an increase in discharge voltage.

Additionally, according to the present embodiment, the cavity 26 satisfies the expressions L≧D and D≦2.0, where D (mm) is the inside diameter of the cavity 26, and L (mm) is the axial length of the cavity 26. Thus, the radial expansion of plasma can be restrained, and the discharge velocity of plasma along the direction of the axis CL1 can be increased. As a result, the discharge length of plasma from the opening of the cavity 26 can be further increased, so that ignition performance can be further improved.

Also, the protrusion 29 and the electrode tip 5D are formed from a metal which contains at least one of W, Ir, etc. Thus, the protrusion 29 and the center electrode 5 can enjoy improvement in resistance to erosion caused by spark discharge and the like. Accordingly, the rate of increase of discharge voltage associated with erosion of the protrusion 29 and the electrode tip 5D can be restrained. As a result, the period when spark discharge and, in turn, plasma, can be generated can be elongated, and channeling can be further restrained.

Furthermore, within a range from the front end surface of the center electrode 5 to an axial position located at least 0.5 mm rearward of the front end surface of the center electrode 5, the outside diameter of the front end surface of the center electrode 5 and the inside diameter of the axial bore 4 are substantially equal to each other. Thus, even at a stage when the center electrode 5 is eroded to a certain extent, almost no clearance is formed between the front end surface of the center electrode 5 and the wall surface of the axial bore 4 (i.e., even when the center electrode 5 is eroded, gaseous discharge is not generated between the center electrode 5 and the wall surface of the axial bore 4). Therefore, an increase in discharge voltage can be restrained, and channeling and erosion of the center electrode 5, etc., can be more reliably prevented.

Figure 6:
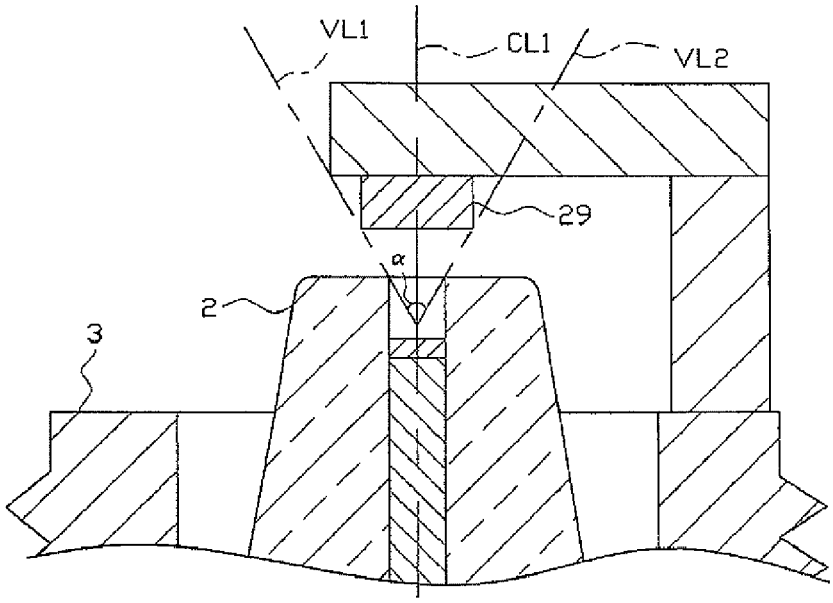
FIG. 6 is an enlarged, fragmentary, sectional view showing the configuration of a sample fabricated for test use.
Figure 7:
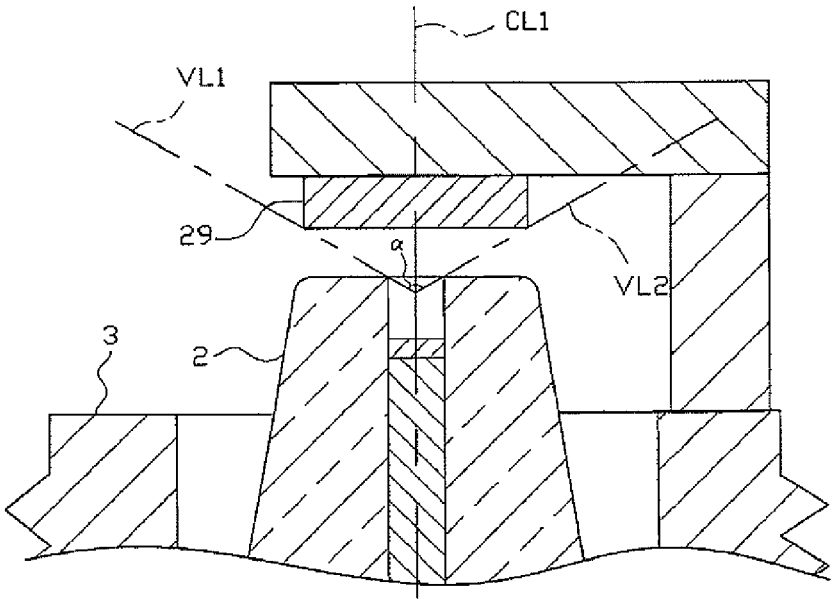
FIG. 7 is an enlarged, fragmentary, sectional view showing the configuration of a sample fabricated for test use.
Figure 8:
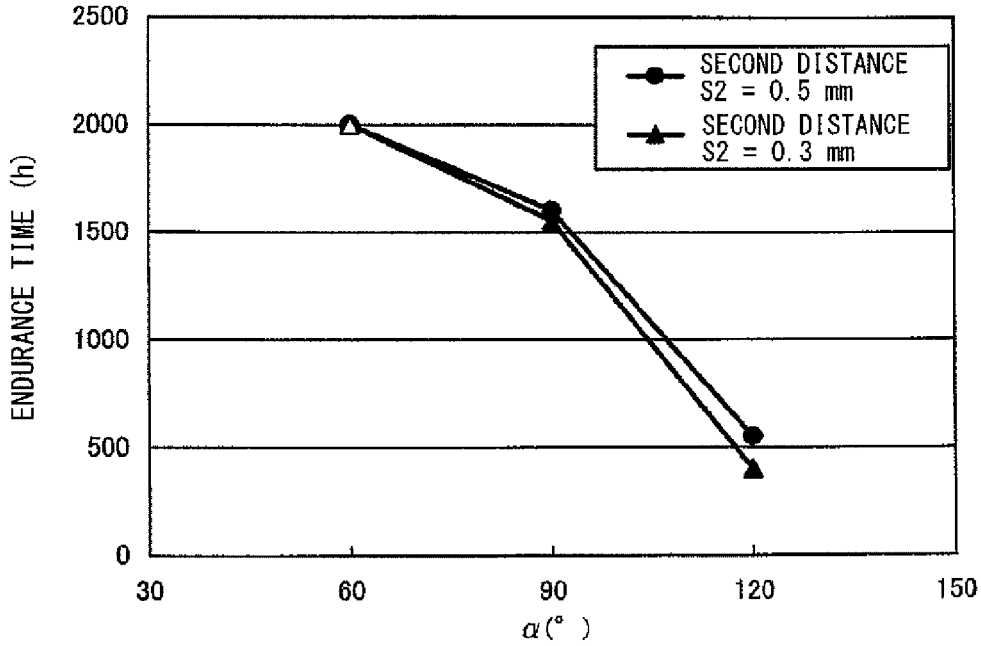
FIG. 8 is a graph showing the results of a channeling resistance test conducted on samples which differ in angle $\alpha$.

Next, in order to verify working effects which the present embodiment yields, as shown in FIGS. 6 and 7, ignition plug samples having a second distance S2 (a gaseous discharge distance) of 0.5 mm or 0.3 mm were fabricated while the width of the protrusion was varied so as to have an angle α of 60 degrees, 90 degrees, or 120 degrees formed on a side toward the protrusion between the imaginary lines VL1 and VL2 drawn in such a manner as to come into contact with the outer edge of the distal end surface of the protrusion. The samples were subjected to a channeling resistance test. The outline of the channeling resistance test is as follows. The samples were mounted to a predetermined chamber. The samples were caused to discharge at a chamber pressure of 0.4 MPa and a frequency of applied voltage of 60 Hz (i.e., the samples discharged 3,600 times per minute) (in the test, power from a plasma power supply was not applied, and only spark discharges were generated). The samples were observed at predetermined intervals for a channeling groove formed in the front end surface of the insulator. When an imaginary circle was drawn with the axis serving as a center, in such a manner as to pass a radially outermost portion of the channeling groove, time that had elapsed until the diameter of the imaginary circle exceeded two times the inside diameter of the cavity (endurance time) was measured. FIG. 8 shows the results of the test. The term "channeling groove" means a groove having a depth of 0.1 mm or greater. In FIG. 8, the test results of the samples having a second distance S2 of 0.5 mm are plotted with circles, and the test results of the samples having a second distance S2 of 0.3 mm are plotted with triangles. The test was conducted for 2,000 hours. In FIG. 8, the test results plotted with an outlined triangle and an outlined circle are of the samples in which, after the elapse of 2,000 hours, the diameter of the imaginary circle was not in excess of two times the inside diameter of the cavity (i.e., the samples whose test results are plotted with an outlined triangle and an outlined circle have an endurance time in excess of 2,000 hours).

As shown in FIG. 8, the samples having an angle α of 90 degrees or less exhibit an endurance time in excess of 1,500 hours, indicating that the samples have excellent resistance to channeling. Conceivably, this is because, by virtue of the outer edge of the distal end surface of the protrusion approaching the axis, a radially outward urge of spark discharge creeping on the inner circumferential surface of the insulator can be effectively restrained. Particularly, the samples having an angle α of 60 degrees exhibit an endurance time of 2,000 hours or more, indicating that the samples have quite excellent resistance to channeling.

As is apparent from the above test results, preferably, in order to more reliably improve resistance to channeling, the protrusion is formed such that the angle α between two imaginary lines drawn, on a section which contains the axis, in contact with the outer edge of the distal end surface of the protrusion and with the opening edge of the cavity and intersecting with each other on the axis is 90 degrees or less. Also, in view of further improvement of resistance to channeling, the protrusion is formed such that the angle α is 60 degrees or less.

Figure 9:
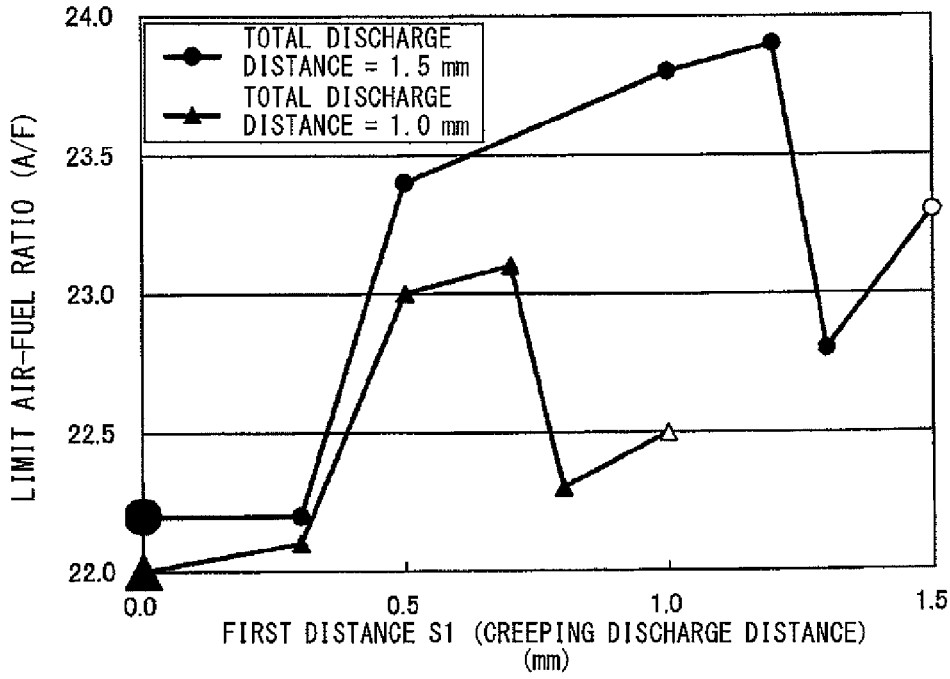
FIG. 9 is a graph showing the results of an ignition performance evaluation test conducted on samples which differ in a first distance and a second distance.
Figure 10:
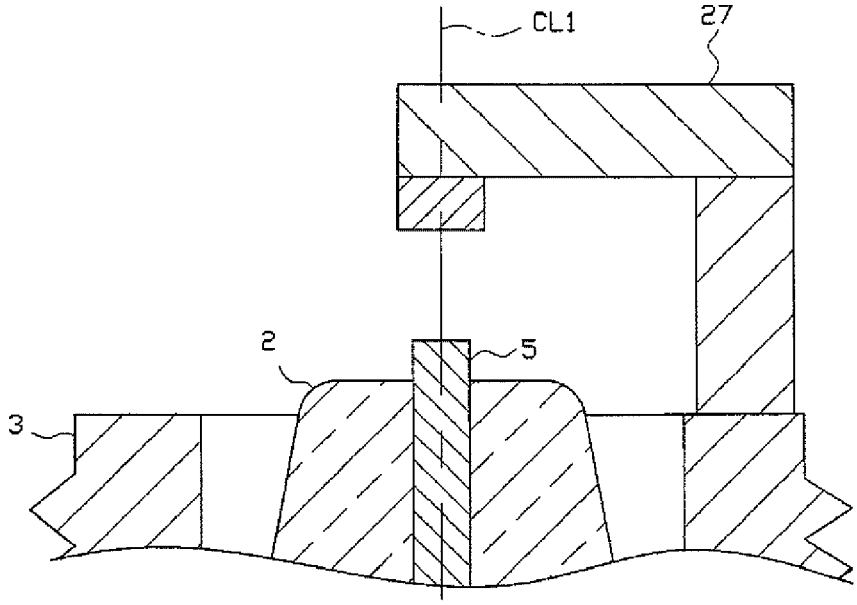
FIG. 10 is an enlarged, fragmentary, sectional view showing the configuration of a sample fabricated for test use and having a first distance of 0.0 mm.
Figure 11:
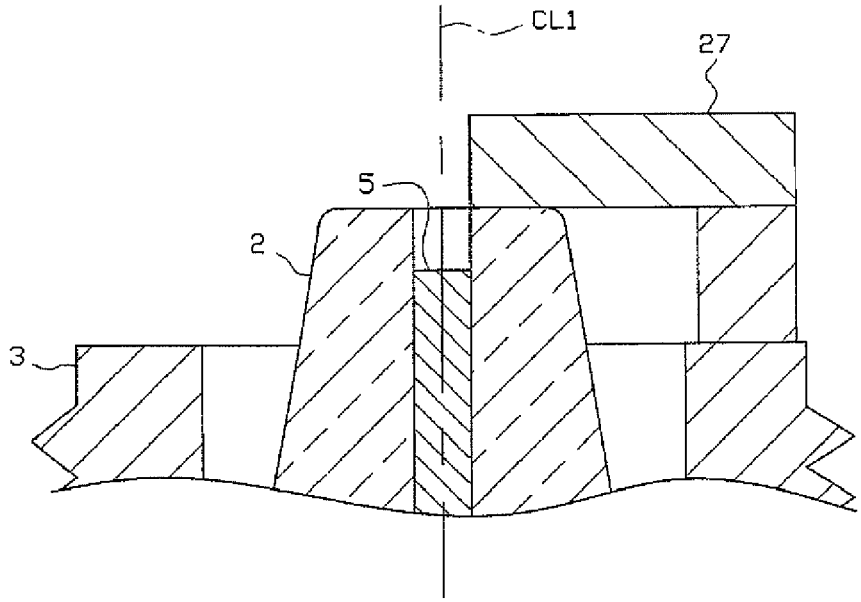
FIG. 11 is an enlarged, fragmentary, sectional view showing the configuration of a sample fabricated for test use and having a second distance of 0.0 mm.

Next, ignition plug samples in which the outside diameter of the center electrode and the inside diameter of the axial bore were substantially equal to each other as measured on a plane which contains the front end surface of the center electrode and in which the total length (total discharge distance) of the first distance S1 (creeping discharge distance) and the second distance S2 (gaseous discharge distance) were held to 1.0 mm or 1.5 mm were fabricated while the first distance S1 was varied. The samples were subjected to an ignition performance evaluation test. The outline of the ignition performance evaluation test is as follows. The samples were mounted to a 4-cylinder engine of 2.0 L displacement. The engine was operated at a speed of 1,600 rpm through generation of spark discharges with ignition timing set to MBT (Minimum Spark Advance for Best Torque) and generation of plasma by application of power from a plasma power supply having an output of 100 mJ. While the air-fuel ratio was being increased (the fuel content was being reduced), the variation rate of engine torque was measured. An air-fuel ratio at which the variation rate of engine torque exceeded 5% was obtained as a limit air-fuel ratio. The higher the limit air-fuel ratio, the better the ignition performance. FIG. 9 shows the results of the test. The sample having a first distance S1 of 0.0 mm is such that, as shown in FIG. 10, the center electrode projects frontward from the front end of the insulator with respect to the axial direction. The sample in which the first distance S1 is equal to the total discharge distance (i.e., the second distance S2 is 0.0 mm) is such that, as shown in FIG. 11, the front end surface of the insulator is in contact with the ground electrode. In FIG. 9, the test results of the samples having a total discharge distance of 1.5 mm are plotted with circles, and the test results of the samples having a total discharge distance of 1.0 mm are plotted with triangles. The test results of the samples having a first distance S1 of 0.0 mm are plotted with a circle and a triangle greater in size than those used to plot the test results of other samples. The test results of the samples having a second distance S2 of 0.0 mm are plotted with an outlined circle or an outlined triangle. The samples had an outside diameter of the center electrode of 0.5 mm. Except for the sample having a second distance S2 of 0.0 mm (the sample having no protrusion), the samples had an outside diameter of the protrusion of the ground electrode of 0.7 mm.

As shown in FIG. 9, the samples having a total discharge distance of 1.5 mm and a first distance S1 in excess of 1.2 mm and the samples having a total discharge distance of 1.0 mm and a first distance S1 in excess of 0.7 mm; i.e., the samples having a second distance S2 of less than 0.3 mm, are inferior in ignition performance. Conceivably, this is for the following reason: since the ground electrode is located in the vicinity of the opening of the cavity, discharge of plasma is apt to be obstructed, and heat of plasma is apt to be transferred to the ground electrode.

Also, the samples having a first distance S1 of less than 0.5 mm have been found to be inferior in ignition performance. Conceivably, this is for the following reason: since the axial length of the cavity is reduced, pressure associated with generation of plasma is likely to cause dispersion of a gas around plasma to the exterior of the cavity, resulting in insufficient growth of plasma.

By contrast, it has been confirmed that the samples having a first distance S1 of 0.5 mm or more and a second distance S2 of 0.3 mm or more exhibit excellent ignition performance.

As is apparent from the above test results, preferably, in order to improve ignition performance, in an ignition plug in which the outside diameter of the center electrode and the inside diameter of the axial bore are substantially equal to each other as measured on a plane which contains the front end surface of the center electrode (i.e., the distance S0 is 0 mm), the first distance S1 is 0.5 mm or more, and the second distance S2 is 0.3 mm or more. More preferably, in order to further improve ignition performance, the second distance S2 is 0.3 mm or more, and the first distance S1 is further elongated (e.g., 0.5 mm or more, or 0.7 mm or more).

Next, ignition plug samples in which a protrusion was provided at a front end portion of the center electrode to thereby form an annular clearance between the center electrode and the wall surface of the axial bore as viewed on a plane which contains the front end surface of the center electrode and in which the total of the distances S0, S1, and S2 was 1.0 mm or 1.5 mm were fabricated while the distances S0, S1, and S2 were varied. The samples were subjected to the above-mentioned ignition performance evaluation test. Table 1 shows the results of the test. In the test, the range from time when the limit air-fuel ratio has improved greatly (time when the air-fuel ratio variation rate becomes +2 or more) to time immediately before the limit air-fuel ratio drops greatly (time immediately before the air-fuel ratio variation rate becomes −2 or less) is considered as a range of a great improvement in ignition performance, and associated samples are evaluated as "Good." The "air-fuel ratio variation rate" is obtained as follows. With regard to the samples having the same distance S0 and the same total of the distances S0, S1, and S2, an increment or decrement in limit air-fuel ratio of a target sample relative to the limit air-fuel ratio of a sample located immediately above the target sample in Table 1 is calculated. The calculated increment or decrement is divided by the limit air-fuel ratio of the sample located immediately above the target sample in Table 1, thereby yielding the "air-fuel ratio variation rate."

TABLE 1

| Distance S0 (mm) | Distance S1 (mm) | Distance S2 (mm) | S0 × 2 + S1 (mm) | S0 + S1 + S2 (mm) | Limit air-fuel ratio (A/F) | Air-fuel ratio variation rate (%) | Evaluation |
|---|---|---|---|---|---|---|---|
| 0.0 | 0.0 | 1.0 | 0.0 | 1.0 | 22.0 | — | Poor |
| 0.0 | 0.3 | 0.7 | 0.3 | 1.0 | 22.1 | 0.5 | Poor |
| 0.0 | 0.5 | 0.5 | 0.5 | 1.0 | 23.0 | 4.1 | Good |
| 0.0 | 0.7 | 0.3 | 0.7 | 1.0 | 23.1 | 0.4 | Good |
| 0.0 | 0.8 | 0.2 | 0.8 | 1.0 | 22.3 | −3.5 | Poor |
| 0.0 | 1.0 | 0.0 | 1.0 | 1.0 | 22.5 | 0.9 | Poor |
| 0.1 | 0.0 | 0.9 | 0.2 | 1.0 | 21.7 | — | Poor |
| 0.1 | 0.1 | 0.8 | 0.3 | 1.0 | 21.8 | 0.5 | Poor |
| 0.1 | 0.3 | 0.6 | 0.5 | 1.0 | 22.6 | 3.7 | Good |
| 0.1 | 0.5 | 0.4 | 0.7 | 1.0 | 23.5 | 4.0 | Good |
| 0.1 | 0.6 | 0.3 | 0.8 | 1.0 | 23.6 | 0.4 | Poor |
| 0.1 | 0.7 | 0.2 | 0.9 | 1.0 | 22.0 | −6.8 | Poor |
| 0.1 | 0.9 | 0.0 | 1.1 | 1.0 | 22.2 | 0.9 | Poor |
| 0.2 | 0.0 | 0.8 | 0.4 | 1.0 | 21.5 | — | Poor |
| 0.2 | 0.1 | 0.7 | 0.5 | 1.0 | 21.4 | −0.5 | Poor |
| 0.2 | 0.3 | 0.5 | 0.7 | 1.0 | 22.8 | 6.5 | Good |
| 0.2 | 0.5 | 0.3 | 0.9 | 1.0 | 23.7 | 3.9 | Good |
| 0.2 | 0.6 | 0.2 | 1.0 | 1.0 | 22.2 | −6.3 | Poor |
| 0.2 | 0.8 | 0.0 | 1.2 | 1.0 | 22.4 | 0.9 | Poor |
| 0.0 | 0.0 | 1.5 | 0.0 | 1.5 | 22.2 | — | Poor |
| 0.0 | 0.3 | 1.2 | 0.3 | 1.5 | 22.2 | 0.0 | Poor |
| 0.0 | 0.5 | 1.0 | 0.5 | 1.5 | 23.4 | 5.4 | Good |
| 0.0 | 1.0 | 0.5 | 1.0 | 1.5 | 23.8 | 1.7 | Good |
| 0.0 | 1.2 | 0.3 | 1.2 | 1.5 | 23.9 | 0.4 | Good |
| 0.0 | 1.3 | 0.2 | 1.3 | 1.5 | 22.8 | −4.6 | Poor |
| 0.0 | 1.5 | 0.0 | 1.5 | 1.5 | 23.1 | 1.3 | Poor |
| 0.1 | 0.0 | 1.4 | 0.2 | 1.5 | 22.0 | — | Poor |
| 0.1 | 0.1 | 1.3 | 0.3 | 1.5 | 22.0 | 0.0 | Poor |
| 0.1 | 0.3 | 1.1 | 0.5 | 1.5 | 23.2 | 5.5 | Good |
| 0.1 | 0.5 | 0.9 | 0.7 | 1.5 | 23.7 | 2.2 | Good |
| 0.1 | 0.9 | 0.5 | 1.1 | 1.5 | 24.1 | 1.7 | Good |
| 0.1 | 1.1 | 0.3 | 1.3 | 1.5 | 24.2 | 0.4 | Good |
| 0.1 | 1.2 | 0.2 | 1.4 | 1.5 | 22.7 | −6.2 | Poor |
| 0.1 | 1.4 | 0.0 | 1.6 | 1.5 | 23.0 | 1.3 | Poor |
| 0.2 | 0.0 | 1.3 | 0.4 | 1.5 | 21.8 | — | Poor |
| 0.2 | 0.1 | 1.2 | 0.5 | 1.5 | 21.6 | −0.9 | Poor |
| 0.2 | 0.3 | 1.0 | 0.7 | 1.5 | 23.5 | 8.8 | Good |
| 0.2 | 0.5 | 0.8 | 0.9 | 1.5 | 24.0 | 2.1 | Good |
| 0.2 | 0.8 | 0.5 | 1.2 | 1.5 | 24.2 | 0.8 | Good |
| 0.2 | 1.0 | 0.3 | 1.4 | 1.5 | 24.3 | 0.4 | Good |
| 0.2 | 1.1 | 0.2 | 1.5 | 1.5 | 22.8 | −6.2 | Poor |
| 0.2 | 1.3 | 0.0 | 1.7 | 1.5 | 23.2 | 1.8 | Poor |

As shown in Table 1, the samples which satisfy the expressions S0×2+S1≧0.5, S1≧0.3, and S2≧0.3 can enjoy a great improvement in ignition performance. Conceivably, this is achieved through the synergy of the follow effects.

(1) Through configuration to satisfy the expression S0×2+S1≧0.5 and employment of a sufficiently long discharge path within the cavity, the amount of plasma generated within the cavity has increased.

(2) Through satisfaction of the expression S1≧0.3 and employment of an axial length of the cavity of 0.3 mm or more, a situation in which pressure associated with generation of plasma causes dispersion of an ambient gas which contributes to the growth of plasma has been unlikely to arise, so that plasma has grown more reliably.

(3) Through satisfaction of the expression S2≧0.3, the obstruction of discharge of plasma by the protrusion, and heat transfer from plasma to the protrusion (ground electrode) have been prevented.

As is apparent from the above test results, preferably, in order to improve ignition performance, the distances S0, S1, S2 when the value of S0+S1×0.5+S2 is minimized satisfy the expressions S0×2+S1≧0.5, S1≧0.3, and S2≧0.3.

Next, ignition plug samples having a distance S0 of 0.0 mm, 0.1 mm, or 0.2 mm were fabricated while the distance S1 and the distance S2 were varied. The samples were subjected to an early-stage discharge-voltage measuring test. The outline of the early-stage discharge-voltage measuring test is as follows. The samples were mounted to a test chamber. While the chamber pressure was held at 0.8 MPa, discharge voltage required for spark discharge (early-stage discharge voltage) was measured. In view of the fact that discharge voltage increases gradually with erosion of the center electrode and that the greater the discharge voltage, the more likely channeling is to arise on the insulator, early-stage discharge voltage is preferably 20 kV or less. Table 2 shows the test results of the samples having a distance S0 of 0.0 mm; Table 3 shows the test results of the samples having a distance S0 of 0.1 mm; and Table 4 shows the test results of the samples having a distance S0 of 0.2 mm.

TABLE 2

| First distance S1 (mm) | Second distance S2 (mm) | S0 + S1 × 0.5 + S2 (mm) | Discharge voltage (kV) | Evaluation |
|---|---|---|---|---|
| 0.0 | 0.3 | 0.30 | 7.0 | Good |
| | 0.5 | 0.50 | 10.2 | Good |
| | 1.0 | 1.00 | 14.9 | Good |
| | 1.5 | 1.50 | 19.7 | Good |
| | 2.0 | 2.00 | 24.2 | Poor |
| 0.5 | 0.0 | 0.25 | 7.5 | Good |
| | 0.3 | 0.55 | 9.3 | Good |
| | 0.5 | 0.75 | 12.3 | Good |
| | 1.0 | 1.25 | 16.7 | Good |
| | 1.5 | 1.75 | 22.5 | Poor |
| 1.0 | 0.0 | 0.50 | 10.5 | Good |
| | 0.3 | 0.80 | 12.7 | Good |
| | 0.5 | 1.00 | 14.5 | Good |
| | 1.0 | 1.50 | 19.0 | Good |
| | 1.5 | 2.00 | 25.0 | Poor |
| 1.5 | 0.0 | 0.75 | 13.0 | Good |
| | 0.3 | 1.05 | 15.2 | Good |
| | 0.5 | 1.25 | 17.7 | Good |
| | 1.0 | 1.75 | 21.3 | Poor |
| | 1.5 | 2.25 | 27.5 | Poor |
| 2.0 | 0.0 | 1.00 | 15.3 | Good |
| | 0.3 | 1.30 | 17.5 | Good |
| | 0.5 | 1.50 | 19.7 | Good |
| | 1.0 | 2.00 | 23.5 | Poor |
| 2.5 | 0.0 | 1.25 | 17.0 | Good |
| | 0.3 | 1.55 | 19.5 | Good |
| | 0.5 | 1.75 | 22.0 | Poor |
| | 1.0 | 2.25 | 26.0 | Poor |
| 3.0 | 0.0 | 1.50 | 19.0 | Good |
| | 0.3 | 1.80 | 22.5 | Poor |
| | 0.5 | 2.00 | 24.7 | Poor |
| | 1.0 | 2.50 | 28.7 | Poor |

S0 = 0.0 mm

TABLE 3

| First distance S1 (mm) | Second distance S2 (mm) | S0 + S1 × 0.5 + S2 (mm) | Discharge voltage (kV) | Evaluation |
|---|---|---|---|---|
| 0.0 | 0.2 | 0.30 | 6.9 | Good |
| | 0.4 | 0.50 | 10.0 | Good |
| | 0.9 | 1.00 | 14.6 | Good |
| | 1.4 | 1.50 | 19.2 | Good |
| | 1.9 | 2.00 | 23.8 | Poor |
| 0.4 | 0.0 | 0.30 | 8.0 | Good |
| | 0.3 | 0.60 | 9.6 | Good |
| | 0.5 | 0.80 | 12.8 | Good |
| | 1.2 | 1.50 | 17.5 | Good |
| | 1.5 | 1.80 | 23.6 | Poor |
| 1.0 | 0.0 | 0.60 | 11.0 | Good |
| | 0.3 | 0.90 | 13.5 | Good |
| | 0.5 | 1.10 | 15.3 | Good |
| | 0.9 | 1.50 | 19.8 | Good |
| | 1.4 | 2.00 | 25.3 | Poor |
| 1.4 | 0.0 | 0.80 | 13.6 | Good |
| | 0.3 | 1.10 | 15.8 | Good |
| | 0.5 | 1.30 | 17.9 | Good |
| | 0.7 | 1.50 | 19.5 | Good |
| | 1.2 | 2.00 | 24.7 | Poor |
| 2.0 | 0.0 | 1.10 | 15.6 | Good |
| | 0.2 | 1.30 | 17.3 | Good |
| | 0.4 | 1.50 | 19.3 | Good |
| | 0.9 | 2.00 | 23.0 | Poor |
| 2.4 | 0.0 | 1.30 | 17.3 | Good |
| | 0.2 | 1.50 | 19.5 | Good |
| | 0.5 | 1.80 | 22.5 | Poor |
| | 0.7 | 2.00 | 24.3 | Poor |
| 2.8 | 0.0 | 1.50 | 19.7 | Good |
| | 0.3 | 1.80 | 22.7 | Poor |
| | 0.5 | 2.00 | 24.9 | Poor |
| | 1.0 | 2.50 | 29.0 | Poor |

S0 = 0.1 mm

TABLE 4

| First distance S1 (mm) | Second distance S2 (mm) | S0 + S1 × 0.5 + S2 (mm) | Discharge voltage (kV) | Evaluation |
|---|---|---|---|---|
| 0.0 | 0.3 | 0.50 | 10.0 | Good |
| | 0.5 | 0.70 | 12.1 | Good |
| | 1.0 | 1.20 | 16.9 | Good |
| | 1.3 | 1.50 | 19.4 | Good |
| | 1.8 | 2.00 | 24.0 | Poor |
| 0.4 | 0.0 | 0.40 | 8.2 | Good |
| | 0.3 | 0.70 | 11.5 | Good |
| | 0.5 | 0.90 | 14.2 | Good |
| | 1.1 | 1.50 | 19.0 | Good |
| | 1.6 | 2.00 | 23.0 | Poor |
| 1.0 | 0.0 | 0.70 | 11.0 | Good |
| | 0.3 | 1.00 | 14.1 | Good |
| | 0.5 | 1.20 | 16.1 | Good |
| | 0.8 | 1.50 | 18.8 | Good |
| | 1.3 | 2.00 | 22.6 | Poor |
| 1.4 | 0.0 | 0.90 | 13.5 | Good |
| | 0.3 | 1.20 | 15.7 | Good |
| | 0.6 | 1.50 | 18.6 | Good |
| | 0.8 | 1.70 | 20.6 | Poor |
| | 1.1 | 2.00 | 22.4 | Poor |
| 2.0 | 0.0 | 1.20 | 15.5 | Good |
| | 0.3 | 1.50 | 18.3 | Good |
| | 0.5 | 1.70 | 20.3 | Poor |
| | 0.8 | 2.00 | 22.0 | Poor |
| 2.4 | 0.1 | 1.50 | 18.2 | Good |
| | 0.3 | 1.70 | 20.1 | Poor |
| | 0.5 | 1.90 | 21.1 | Poor |
| | 1.1 | 2.50 | 28.5 | Poor |
| 2.6 | 0.0 | 1.50 | 18.6 | Good |
| | 0.3 | 1.80 | 21.5 | Poor |
| | 0.5 | 2.00 | 22.4 | Poor |
| | 1.1 | 2.60 | 28.9 | Poor |

S0 = 0.2 mm

As is apparent from Tables 2 to 4, the samples in which the value of S0+S1×0.5+S2 is 1.5 mm or less can more reliably exhibit an early-stage discharge voltage of 20 kV or less.

As is apparent from the above test results, in view of prevention of misfire and progress of channeling associated with an increase in discharge voltage, preferably, the distances S0, S1, and S2 satisfy the expression S0+S1×0.5+S2≦1.5 (mm).

Figure 12:
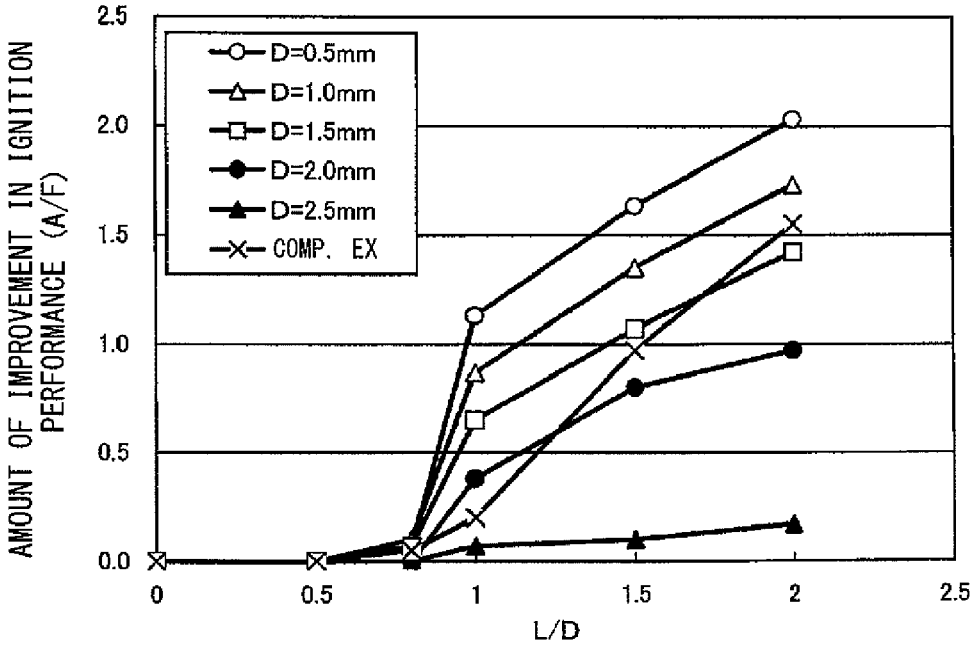
FIG. 12 is a graph showing the amount of improvement in ignition performance for samples which differ in the inside diameter of the cavity, etc.

Next, ignition plug samples of the present invention having an inside diameter D (mm) of the cavity of 0.5 mm, 1.0 mm, 1.5 mm, 2.0 mm, or 2.5 mm were fabricated while the axial length L (mm) of the cavity was varied for varying L/D. Also, ignition plug samples of a comparative example (samples in which only discharge creeping on the inner circumferential surface of the insulator is generated) having an inside diameter D of the cavity of 0.5 mm and a second distance S2 of 0.0 mm were fabricated while the length L of the cavity was varied. The samples were subjected to the above-mentioned ignition performance evaluation test. The samples according to the present invention were measured for increment in limit air-fuel ratio (amount of improvement in ignition performance) from a limit air-fuel ratio obtained through the ignition evaluation test conducted on a sample having a first distance S1 of 0.0 mm and a second distance S2 of 0.5 mm (i.e., a sample in which only gaseous discharge is generated). The samples according to the comparative example were measured for the amount of improvement in ignition performance on the basis of the limit air-fuel ratio of a sample having a first distance S1 of 0.5 mm, a second distance S2 of 0.0 mm, and an inside diameter D of the cavity of 0.5 mm. FIG. 12 shows the results of the test. In FIG. 12, the test results of the samples according to the present invention are represented as follows: the test results of the samples having an inside diameter D of 0.5 mm are plotted with outlined circles; the test results of the samples having an inside diameter D of 1.0 mm are plotted with outlined triangles; the test results of the samples having an inside diameter D of 1.5 mm are plotted with outlined squares; the test results of the samples having an inside diameter D of 2.0 mm are plotted with black circles; and the test results of the samples having an inside diameter D of 2.5 mm are plotted with black triangles. The test results of the samples according to the comparative example are plotted with cross marks.

As is apparent from FIG. 12, the samples in which the length L of the cavity is smaller than the inside diameter D of the cavity (i.e., the samples having an L/D of less than 1.0 (L/D<1.0)) do not improve much in ignition performance even though the length L is increased. Conceivably, this is for the following reason. Since the inside diameter D of the cavity is greater than the length L of the cavity, plasma is apt to expand radially, causing a drop in the discharge velocity of plasma along the axial direction and, in turn, a reduction in the discharge length of plasma from the cavity.

Also, as is apparent from FIG. 12, even in the case of the samples having an UD equal to or greater than 1.0 (L/D≧1.0 (L≧D)), the samples having an inside diameter D of the cavity in excess of 2.0 mm show almost no change in ignition performance even though the length L of the cavity is varied. Conceivably, this is for the following reason. Since the inside diameter of the cavity is large, plasma expands radially, resulting in a reduction in the discharge length of plasma.

Also, it has been confirmed that the samples according to the comparative example exhibit improvement in ignition performance when L/D is 1.5 or greater; i.e., when the length L of the cavity is sufficiently greater than the inside diameter D of the cavity.

By contrast, it has been confirmed that the samples according to the present invention exhibit a great improvement in ignition performance when the inside diameter D of the cavity is 2.0 mm or less, and L/D is equal to or greater than 1.0 (L/D≧1.0 (L≧D)) (i.e., without need to excessively increase the length L of the cavity relative to the inside diameter D of the cavity).

As is apparent from the above test results, preferably, in order to further improve ignition performance, the inside diameter D and the length L of the cavity satisfy the expressions L≧D and D≦2.0 mm.

When the inside diameter D of the cavity is less than 0.5 mm, in a low-temperature environment immediately after startup, the cavity is apt to be clogged with liquefied fuel. Thus, startup performance may deteriorate. Also, since reducing the diameter of the cavity is accompanied by a reduction in the diameter of the center electrode, the heat resistance and erosion resistance of the center electrode may deteriorate. Therefore, preferably, the inside diameter D of the cavity is 0.5 mm or greater.

The present invention is not limited to the above-described embodiment, but may be embodied, for example, as follows. Of course, applications and modifications other than those exemplified below are also possible.

Figure 13:
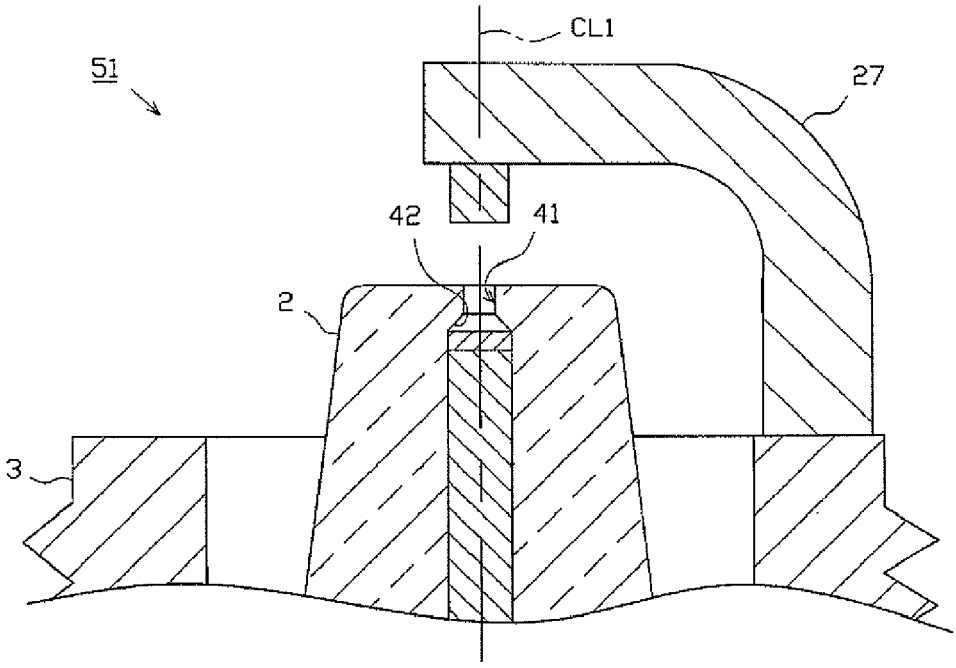
FIG. 13 is an enlarged, fragmentary, sectional view showing the configuration of the cavity in another embodiment.
Figure 14:
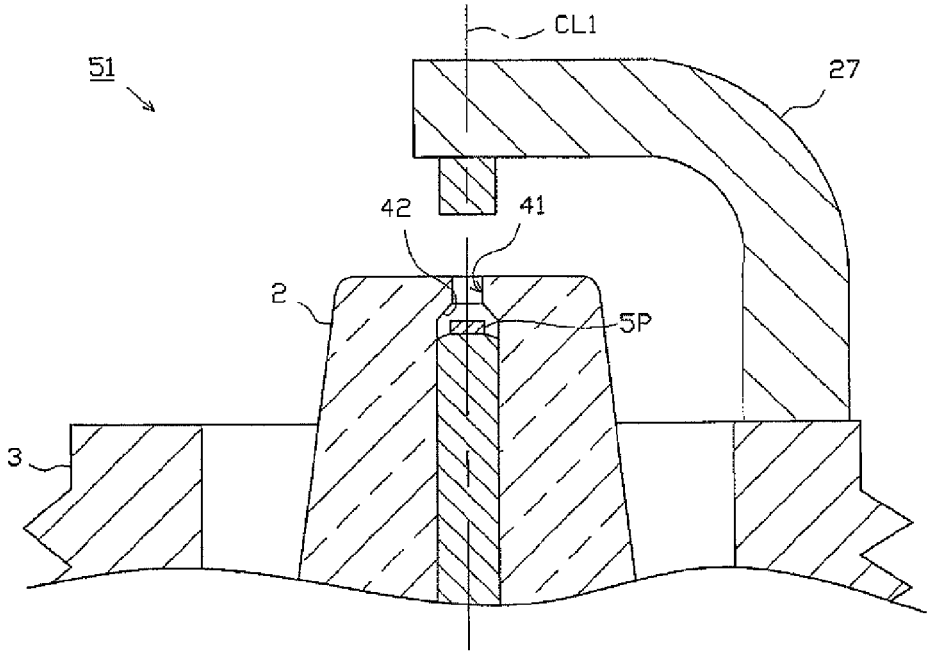
FIG. 14 is an enlarged, fragmentary, sectional view showing the configuration of the cavity in a further embodiment.

(a) In the above embodiment, the cavity 26 assumes a circular columnar shape. However, the shape of the cavity 26 is not limited thereto. As shown in FIGS. 13 and 14, a plasma ignition plug 51 may be configured such that a cavity 41 has a diameter-reduced portion 42 whose diameter decreases toward the opening of the cavity 41. In this case, by virtue of the diameter-reduced portion 42, the discharge force of plasma increases, whereby ignition performance can be improved. Meanwhile, the provision of the diameter-reduced portion 42 involves concern about channeling at the diameter-reduced portion 42. However, through application of the present invention, resistance to channeling can be improved, thereby ignoring the concern. That is, the present invention can reliably eliminate the demerit associated with provision of the diameter-reduced portion 42. As a result, a merit associated with provision of the diameter-reduced portion 42 can be exhibited reliably over a long period of time.

Figure 15:
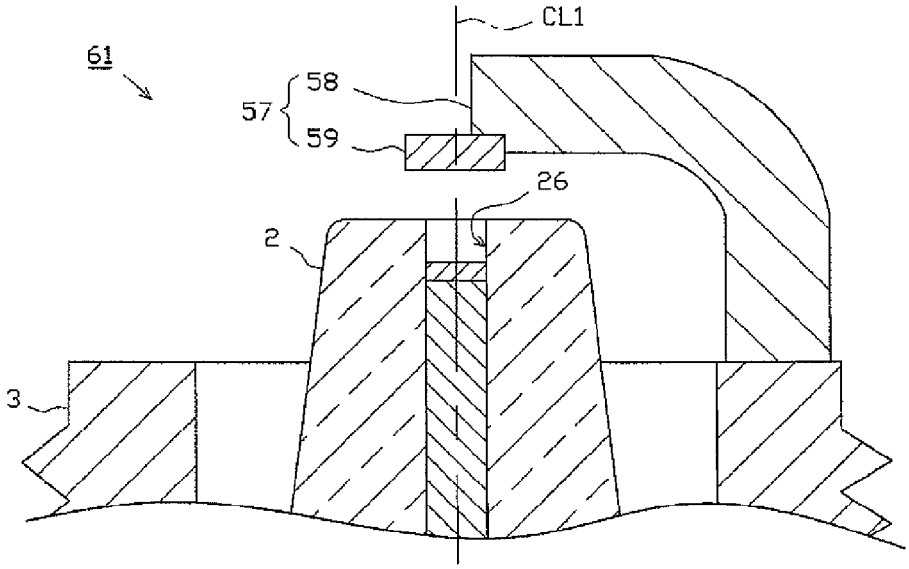
FIG. 15 is an enlarged, fragmentary, sectional view showing the configuration of a ground electrode in a still further embodiment.

(b) In the above embodiment, the body 28 of the ground electrode 27 faces the opening of the cavity 26. However, as shown in FIG. 15, a plasma jet ignition plug 61 may be configured as follows: while a prismatic protrusion 59 projects from the distal end surface of a body 58 of a ground electrode 57 and faces the opening of the cavity 26, a portion of the body 58 which overhangs the opening of the cavity 26 is reduced. In this case, while the effect of improving resistance to channeling is maintained through the protrusion 59 being disposed in such a manner as to face the opening of the cavity 26, the obstruction of discharge of plasma by the body 58 or a like problem is effectively restrained, whereby ignition performance can be further improved.

Figure 16:
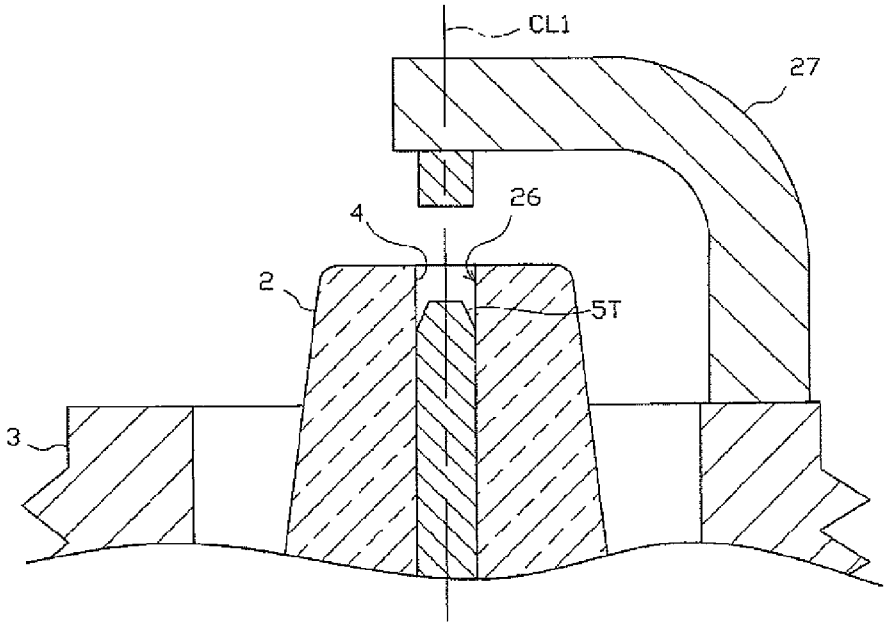
FIG. 16 is an enlarged, fragmentary, sectional view showing the configuration of the center electrode in yet another embodiment.

(c) In the above embodiment, a front end portion of the center electrode 5 assumes a circular columnar shape. However, as shown in FIG. 16, a front end portion of the center electrode 5 may be formed into a taper portion 5T tapered frontward with respect to the direction of the axis CL1, thereby forming a clearance between the outer circumferential surface of the front end portion (taper portion 5T) of the center electrode 5 and the wall surface of the axial bore 4.

(d) In the above embodiment, the ground electrode 27 is configured such that the protrusion 29 protrudes from a side surface of the body 28 located on a side toward the cavity 26. However, the ground electrode may be configured such that the protrusion protrudes from the outer surface of the body.

Figure 17:
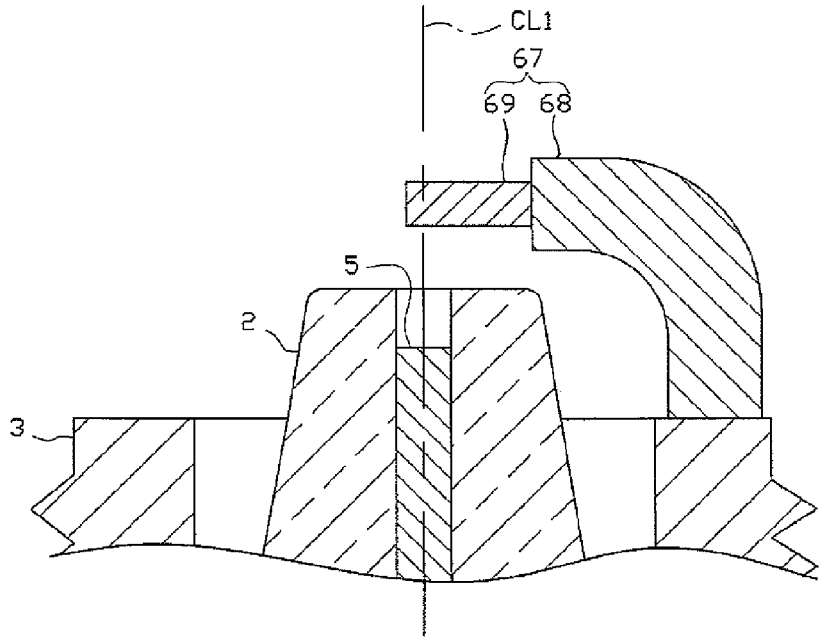
FIG. 17 is an enlarged, fragmentary, sectional view showing the configuration of the ground electrode in another embodiment.

Thus, for example, as shown in FIG. 17, a ground electrode 67 may be configured such that a protrusion 69 protrudes from the distal end surface of a body 68.

(e) In the above embodiment, only a single ground electrode is provided. However, a plurality of ground electrodes may be provided.

(f) In the above embodiment, the electrode tip 5D is provided at a front end portion of the center electrode 5. However, the center electrode 5 may be configured without provision of the electrode tip 5D.

(g) In the above embodiment, the tool engagement portion 19 has a hexagonal cross section. However, the shape of the tool engagement portion 19 is not limited thereto. For example, the tool engagement portion 19 may have a Bi-HEX (modified dodecagonal) shape [ISO22977:2005(E)] or the like.

DESCRIPTION OF REFERENCE NUMERALS

1, 51, 61: plasma jet ignition plug (ignition plug);
2: insulator;
3: metallic shell;
4: axial bore;
5: center electrode;
26, 41: cavity;
27, 57: ground electrode;
28, 58: body;
29, 59: protrusion;
29F: distal end surface of protrusion;
42: diameter-reduced portion;
CL1: axis;
VL1: first imaginary line; and
VL2: second imaginary line.

Having described the invention, the following is claimed:

1. A plasma jet ignition plug comprising:
an insulator having an axial bore extending therethrough in a direction of an axis;
a center electrode inserted into the axial bore in such a manner that a front end thereof is located rearward of a front end of the insulator with respect to the direction of the axis;
a metallic shell disposed externally of an outer circumference of the insulator; and
a ground electrode fixed to a front end portion of the metallic shell;
a cavity being defined by a wall surface of the axial bore and a front end surface of the center electrode;
wherein the ground electrode comprises
a rodlike body configured such that a proximal end portion thereof is fixed to the front end portion of the metallic shell, an intermediate portion thereof is bent, and a distal end portion thereof is disposed away from and frontward of the front end of the insulator with respect to the direction of the axis, and
a protrusion protruding from a surface of the body, and
as viewed on an imaginary plane which is orthogonal to the direction of the axis and onto which an opening of the cavity and the protrusion are projected, a projected image of the opening of the cavity and a projected image of the protrusion overlap at least partially.

2. A plasma jet ignition plug according to claim 1, wherein the protrusion protrudes such that a distal end surface thereof protrudes from a side surface of the body located on a side toward the cavity.

3. A plasma jet ignition plug according to claim 2, wherein the protrusion exists between a first imaginary line and a second imaginary line drawn, on a section which contains the axis, in such a manner that the first imaginary line and the second imaginary line are in contact with an opening edge of the cavity, an intersection of the first and second imaginary lines is located on the axis, and an angle between the first and second imaginary lines on a side toward the protrusion is 90 degrees.

4. A plasma jet ignition plug according to claim 3, wherein the protrusion exists between the first imaginary line and the second imaginary line drawn in such a manner that the angle between the first and second imaginary lines on the side toward the protrusion is 60 degrees.

5. A plasma jet ignition plug according to claim 1, wherein the protrusion is located such that a straight line extending from a center axis of the protrusion passes through the opening of the cavity.

6. A plasma jet ignition plug according to claim 1, satisfying expressions $S0\times2+S1\geqq0.5$, $S1\geqq0.3$, and $S2\geqq0.3$ when a value of $S0+S1\times0.5+S2$ is minimized, where
S0 (mm) is a distance from the front end surface of the center electrode to a point on the wall surface of the axial bore;
S1 (mm) is a distance from the point on the wall surface of the axial bore to the opening edge of the cavity as measured along an inner circumferential surface of the insulator; and
S2 (mm) is a distance from the opening edge of the cavity to the protrusion as measured along the direction of the axis.

7. A plasma jet ignition plug according to claim 1, wherein distance S0 (mm) from the front end surface of the center electrode to a point on the wall surface of the axial bore, distance S1 (mm) from the point on the wall surface of the axial bore to the opening edge of the cavity as measured along the inner circumferential surface of the insulator, and distance S2 (mm) from the opening edge of the cavity to the protrusion as measured along the direction of the axis satisfy an expression $$S0+S1\times0.5+S2\leqq1.5\ (\text{mm}).$$

8. A plasma jet ignition plug according to claim 1, wherein the cavity has a diameter-reduced portion whose diameter reduces toward the opening of the cavity.

9. A plasma jet ignition plug according to claim 1, wherein:
the cavity is a circular columnar space, and
the cavity satisfies the following expressions (1) and (2), $$L\geqq D \quad (1), \text{ and}$$

$$0.5\leqq D\leqq2.0 \quad (2),$$

where D (mm) is an inside diameter of the cavity, and L (mm) is a length of the cavity along the axis.

10. A plasma jet ignition plug according to claim 1, wherein the protrusion is formed from a metal which contains at least one of tungsten, iridium, platinum, and nickel.

11. A plasma jet ignition plug according to claim 1, wherein the center electrode is formed such that a portion of the center electrode which extends rearward by 0.3 mm from a front end of the center electrode in the direction of the axis is formed from a metal which contains at least one of tungsten, iridium, platinum, and nickel.

12. A plasma jet ignition plug according to claim 1, wherein the center electrode and the axial bore are configured such that, as viewed on a section of the axial bore which contains the front end surface of the center electrode, an outside diameter of the front end surface of the center electrode and an inside diameter of the axial bore are substantially equal to each other.

13. A plasma jet ignition plug according to claim 12, wherein the center electrode and the protrusion are in such a positional relation that, when a first distance represents a shortest distance from the front end surface of the center electrode to the opening edge of the cavity as measured along the inner circumferential surface of the insulator, and a second distance represents a shortest distance from the opening edge of the cavity to the protrusion as measured along the direction of the axis, the first distance is 0.5 mm or more, and the second distance is 0.3 mm or more.

14. A plasma jet ignition plug according to claim 12, wherein the center electrode and the protrusion are in such a positional relation that, when a first distance S1 (mm) represents a shortest distance from the front end surface of the center electrode to the opening edge of the cavity as measured along the inner circumferential surface of the insulator, and a second distance S2 (mm) represents a shortest distance from the opening edge of the cavity to the protrusion as measured along the axis, the first distance S1 and the second distance S2 satisfy an expression $$S1 \times 0.5 + S2 \leqq 1.5 \text{ (mm)}.$$

* * * * *